US012753040B2

(12) United States Patent
Fujita et al.

(10) Patent No.: US 12,753,040 B2
(45) Date of Patent: Oct. 6, 2026

(54) MEDIUM PROCESSING APPARATUS, IMAGE FORMING APPARATUS, AND IMAGE FORMING SYSTEM

(71) Applicants: Suzuka Fujita, Kanagawa (JP); Yuusuke Shibasaki, Tokyo (JP); Yusuke Hirono, Kanagawa (JP); Atsushi Shinoda, Kanagawa (JP); Shuuto Tohkaishi, Kanagawa (JP); Satoshi Hirata, Kanagawa (JP); Shingo Yoshizawa, Kanagawa (JP); Naofumi Yoshida, Kanagawa (JP); Ryota Takayama, Kanagawa (JP); Takahiro Watanabe, Kanagawa (JP); Takuya Morinaga, Tokyo (JP); Yuji Suzuki, Kanagawa (JP); Wataru Nozaki, Kanagawa (JP); Kanako Fujisaki, Kanagawa (JP); Jun Yamada, Kanagawa (JP)

(72) Inventors: Suzuka Fujita, Kanagawa (JP); Yuusuke Shibasaki, Tokyo (JP); Yusuke Hirono, Kanagawa (JP); Atsushi Shinoda, Kanagawa (JP); Shuuto Tohkaishi, Kanagawa (JP); Satoshi Hirata, Kanagawa (JP); Shingo Yoshizawa, Kanagawa (JP); Naofumi Yoshida, Kanagawa (JP); Ryota Takayama, Kanagawa (JP); Takahiro Watanabe, Kanagawa (JP); Takuya Morinaga, Tokyo (JP); Yuji Suzuki, Kanagawa (JP); Wataru Nozaki, Kanagawa (JP); Kanako Fujisaki, Kanagawa (JP); Jun Yamada, Kanagawa (JP)

(73) Assignee: Richoh Company, Ltd., Tokyo (JP)

( * ) Notice: Subject to any disclaimer, the term of this patent is extended or adjusted under 35 U.S.C. 154(b) by 268 days.

(21) Appl. No.: 18/741,569

(22) Filed: Jun. 12, 2024

(65) Prior Publication Data

US 2024/0417205 A1 Dec. 19, 2024

(30) Foreign Application Priority Data

Jun. 15, 2023 (JP) ..... 2023-098751

(51) Int. Cl.
*B65H 37/04* (2006.01)
*B65H 7/02* (2006.01)

(52) U.S. Cl.
CPC ..... *B65H 37/04* (2013.01); *B65H 7/02* (2013.01); *B65H 2511/20* (2013.01); *B65H 2801/27* (2013.01)

(58) Field of Classification Search
CPC ..... B65H 37/04; B65H 2801/27; B42C 1/12; B42C 1/125; B31F 5/001; B31F 5/02; G03G 15/6541; G03G 2215/00822
(Continued)

(56) References Cited

U.S. PATENT DOCUMENTS 5,342,033 A 8/1994 Iwata et al.
8,226,079 B2 * 7/2012 Ozawa ..... B65H 31/34 270/58.08

(Continued)

FOREIGN PATENT DOCUMENTS

JP S63-192061 U 12/1988
JP 2013-126911 A 6/2013

(Continued)

OTHER PUBLICATIONS

Espacenet machine translation of JP2019181733A; https://translationportal.epo.org/emtp/translate/?ACTION=description-retrieval&COUNTRY=JP&ENGINE=google&FORMAT=docdb&KIND=A&LOCALE=en_EP&NUMBER=2019181733&OPS=ops.epo.org/3.2&SRCLANG=ja&TRGLANG=en (Year: 2019).*

(Continued)

*Primary Examiner* — Leslie A Nicholson, III
(74) *Attorney, Agent, or Firm* — Duft & Bornsen, PC

(57) ABSTRACT

A medium processing apparatus includes: a binder to bind multiple sheets at a binding position to form a sheet bundle; a sheet inserter having an opening into which the sheet bundle is insertable from an outside of the sheet inserter to a bindable region having the binding position; and a binding position verifier allowing the multiple sheets, inserted from the opening to the bindable region, to be verifiable from an outside of the sheet inserter.

15 Claims, 24 Drawing Sheets

(58) Field of Classification Search
USPC ..... 270/58.08, 58.09
See application file for complete search history.

(56) References Cited

U.S. PATENT DOCUMENTS

| | | | | |
|---|---|---|---|---|
| 9,505,581 | B2 * | 11/2016 | Kai | B65H 43/00 |
| 9,586,429 | B2 * | 3/2017 | Nakagomi | B42C 1/12 |
| 9,776,449 | B2 * | 10/2017 | Shimura | B42C 1/12 |
| 9,969,144 | B1 * | 5/2018 | Awano | B42B 5/00 |
| 11,027,567 | B2 * | 6/2021 | Sugiyama | B42C 1/12 |
| 2010/0117288 | A1 | 5/2010 | Taki et al. | |
| 2024/0025692 | A1 * | 1/2024 | Katsumata | B65H 31/02 |

FOREIGN PATENT DOCUMENTS

| | | | | |
|---|---|---|---|---|
| JP | 2018-167937 | A | | 11/2018 |
| JP | 2019-093554 | A | | 6/2019 |
| JP | 2019181733 | A | * | 10/2019 |
| JP | 2020-083598 | A | | 6/2020 |

OTHER PUBLICATIONS

U.S. Appl. No. 18/582,543, filed Feb. 20, 2024.
European Search Report; Application EP24181031; Nov. 22, 2024.

* cited by examiner

MEDIUM PROCESSING APPARATUS, IMAGE FORMING APPARATUS, AND IMAGE FORMING SYSTEM

CROSS-REFERENCE TO RELATED APPLICATIONS

This patent application is based on and claims priority pursuant to 35 U.S.C. § 119 (a) to Japanese Patent Application No. 2023-098751, filed on Jun. 15, 2023, in the Japan Patent Office, the entire disclosure of which is hereby incorporated by reference herein.

BACKGROUND

Technical Field

The present disclosure relates to a medium processing apparatus, an image forming apparatus, and an image forming system.

Related Art

A medium processing apparatus performs predetermined processing to a sheet-shaped medium as a processing target. In addition, an image forming apparatus includes a functional unit corresponding to a medium processing apparatus in its housing and forms an image on a sheet-shaped medium and an image forming system including a medium processing apparatus and an image forming apparatus that are coupled together.

A plurality of types of predetermined sheet processing (also referred to as "post-processing" because of corresponding to a post-process in image forming processing) is performable by such a medium processing apparatus. For example, "binding processing" for binding multiple sheets as media in a bundle and punching processing for punching a sheet.

Examples of such binding processing include "on-line binding" and "off-line binding". In the on-line binding, respective ends of sheets subjected to image forming are aligned and then the aligned ends are bound, followed by ejection of the sheets as a sheet bundle. In the off-line binding, sheets subjected to image forming are ejected to, for example, an ejection tray and then a user bundles the ejected sheets together, followed by binding processing.

SUMMARY

The present disclosure described herein provide a medium processing apparatus includes: a binder to bind multiple sheets at a binding position to form a sheet bundle; a sheet inserter having an opening into which the sheet bundle is insertable from an outside of the sheet inserter to a bindable region having the binding position; and a binding position verifier allowing the multiple sheets, inserted from the opening to the bindable region, to be verifiable from an outside of the sheet inserter.

BRIEF DESCRIPTIONS OF THE DRAWINGS

A more complete appreciation of embodiments of the present disclosure and many of the attendant advantages and features thereof can be readily obtained and understood from the following detailed description with reference to the accompanying drawings, wherein.

Figure 1:
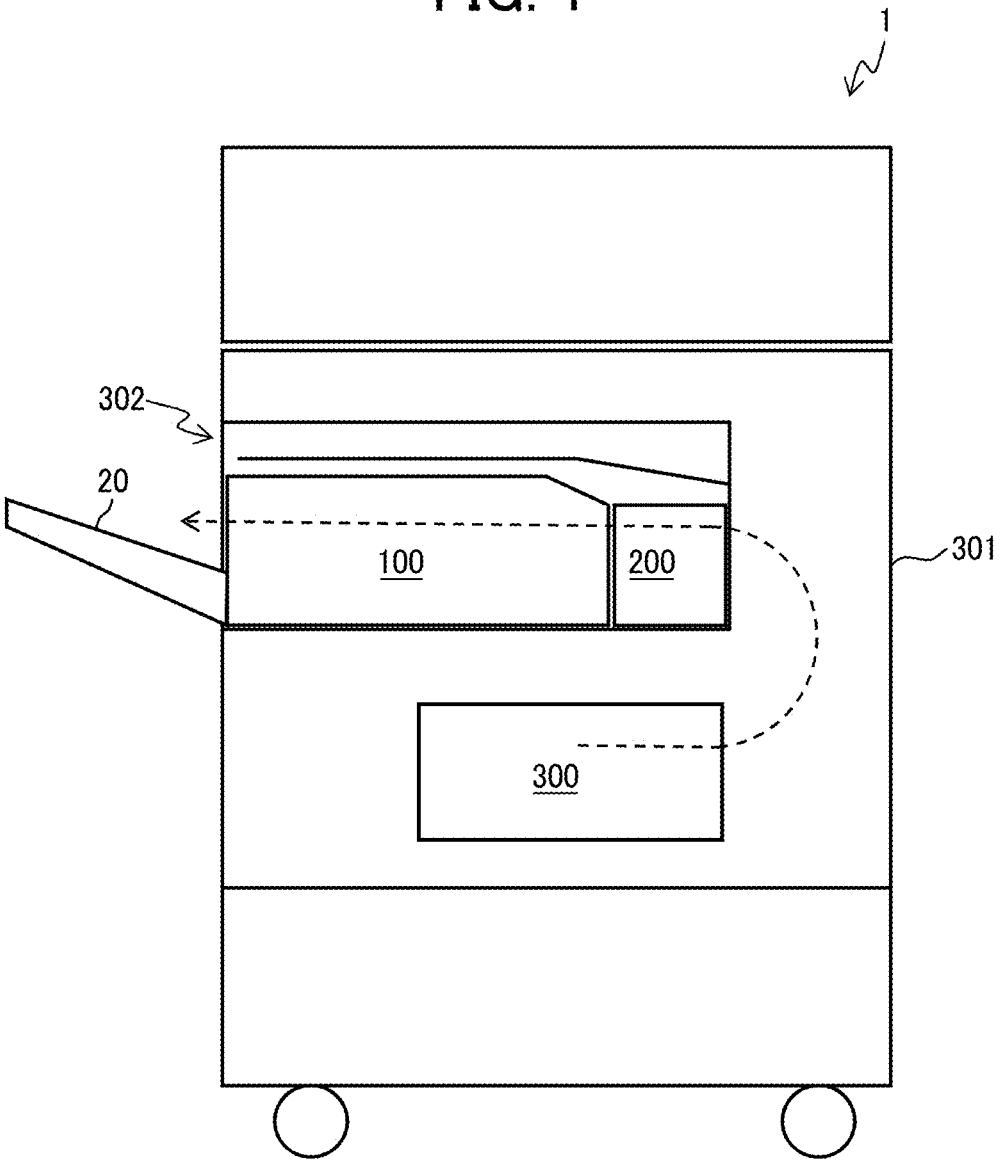
FIG. 1 is an external view of an exemplary multifunction peripheral (MFP) as an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Hereinafter, embodiments of a liquid coater, a method of controlling the liquid coater, and an image forming system according to the present disclosure will be described with reference to the accompanying drawings.

Image Forming Apparatus According to Embodiment

Figure 2:
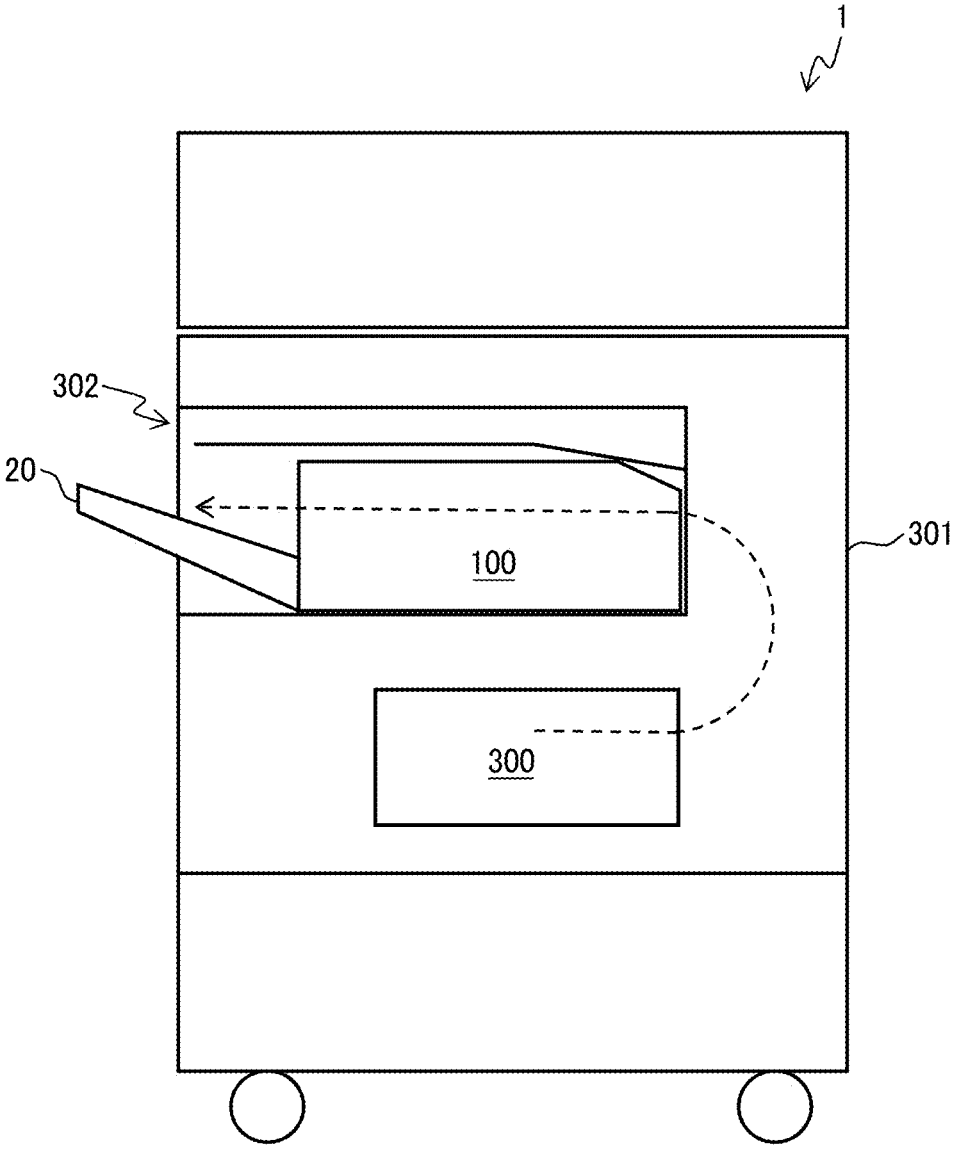
FIG. 2 is an external view of another exemplary MFP as the image forming apparatus according to the embodiment of the present disclosure.

A multifunction peripheral (MFP) 1 as an image forming apparatus according to an embodiment of the present disclosure will be described with reference to the drawings. FIGS. 1 and 2 are each an external view of an MFP 1 according to the present embodiment. Such an MFP 1 has an image forming function for forming an image on a sheet S (typically, a sheet of paper) as a sheet-shaped medium and a post-processing function for performing predetermined sheet processing (post-processing) to the sheet S on which the image is recorded.

As illustrated in FIG. 1, the MFP 1 includes mainly a housing 301 and an image forming device 300 inside the housing 301. The housing 301 is boxy and has an inner space that houses the constituent elements of the MFP 1. The housing 301 has an internal space 302 accessible from outside the MFP 1. The internal space 302 is a section exposed outward due to partial removal of the outer wall of the housing 301 and is located, for example, slightly higher than the center in the vertical direction of the housing 301.

As optional units for adding optional functions, a punching processing unit 200 and a binding processing unit 100 are attachable to the internal space 302. The punching processing unit 200 enables punching processing, and the binding processing unit 100 enables binding processing for binding multiple sheets S in a bundle. Note that the binding processing unit 100 corresponds to a medium processing apparatus according to an embodiment of the present disclosure. The binding processing unit 100 is also referred to as "a binder".

The image forming device 300 ejects, to the punching processing unit 200 or the binding processing unit 100, a sheet S conveyed due to pick up from a sheet housing tray. The image forming device 300 may be of an inkjet type that forms an image with ink or may be of an electrophotographic type that forms an image with toner. The image forming device 300 has an already known configuration and thus a detailed description thereof will be omitted.

The punching processing unit 200 is attached to the internal space 302 of the MFP 1 such that the punching processing unit 200 is located downstream of the image forming device 300 and upstream of the binding processing unit 100 on a conveyance path for sheets S ranging from the image forming device 300 to the binding processing unit 100 (on a path indicated with a dashed arrow in FIG. 1). That is, in the example with the MFP 1, a sheet S on which an image is formed by the image forming device 300 is delivered to the punching processing unit 200 and then is subjected to predetermined punched-hole forming processing. After that, the sheet S is delivered to the binding processing unit 100 and then is subjected to binding processing described later.

Note that the punching processing unit 200 is detachably attachable to the MFP 1. Removal of the punching processing unit 200 results in a state exemplified in FIG. 2. In this case, a sheet S on which an image is formed by the image forming device 300 is directly delivered to the binding processing unit 100 and then is subjected to binding processing. Note that a processing unit for optional processing to sheets S can be attached to the position from which the punching processing unit 200 is removed in the internal space 302.

Figure 3:
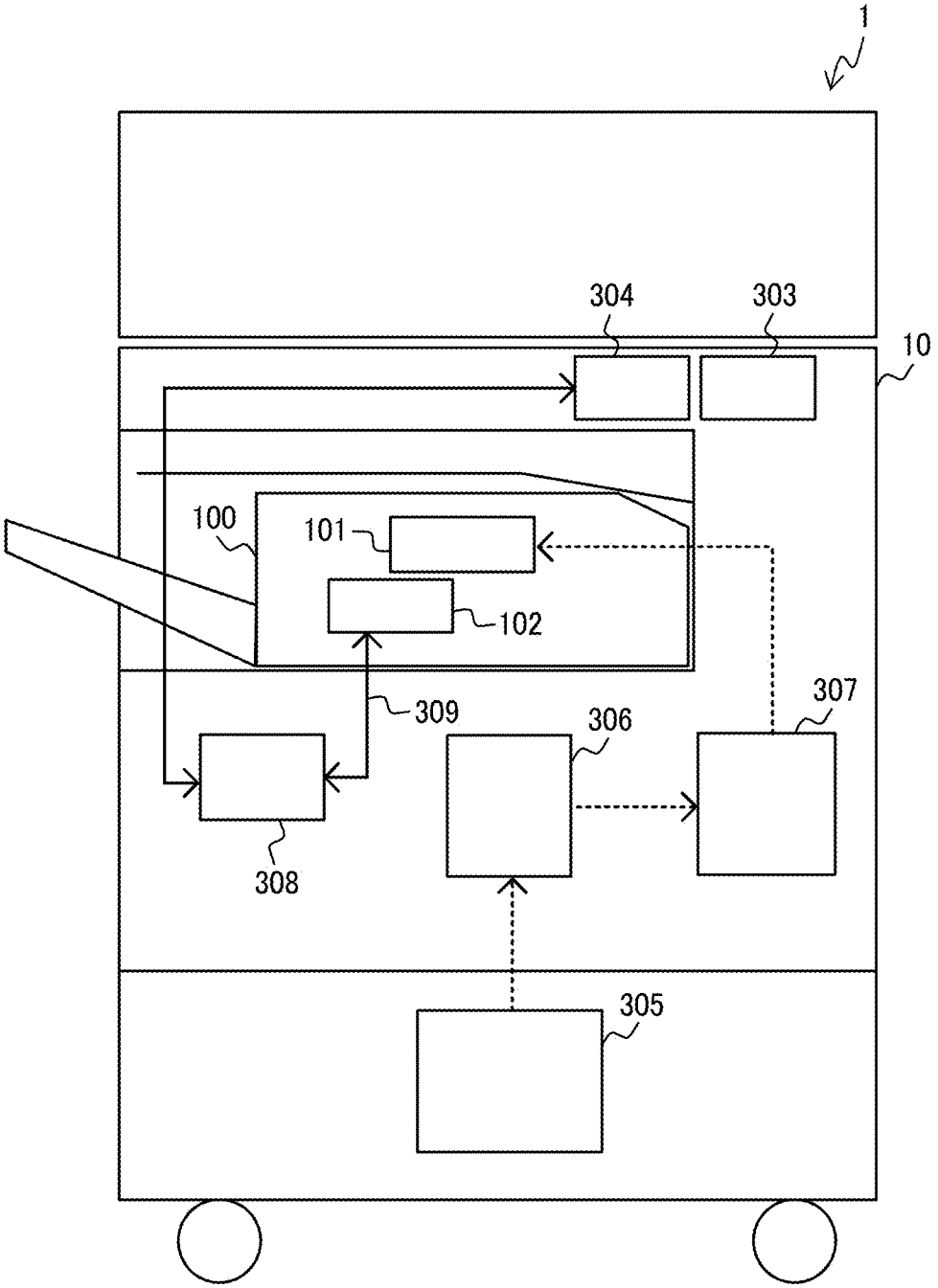
FIG. 3 is a functional block diagram corresponding to another exemplary MFP according to the present embodiment.

Control Configuration of Image Forming Apparatus Including Medium Processing Apparatus Next, a control configuration of such an MFP 1 including a binding processing unit 100 will be described with FIG. 3. FIG. 3 exemplifies a control configuration of an MFP 1 from which a punching processing unit 200 is removed.

Referring to FIG. 3, a conveyance path for sheets S (a flow of sheets S) is indicated with dashed arrows, and a path for communication signals (control signals) (flows of signals) is indicated with solid arrows.

The MFP 1 includes a display 303 that notifies a user of the state of each type of device or operation details, an operation device 304 that a user operates to set, for example, a mode or the number of copies, and a sheet feeding device 305 that stores sheets S and feeds the sheets S sheet by sheet. The MFP 1 includes an imaging device 306 that forms a latent image on a photoconductor such that an image is transferred to a sheet S, and a fixing device 307 that fixes the image transferred to the sheet S. The MFP 1 further includes an image formation controller 308 that controls the operation of each device described above.

The binding processing unit 100 as an exemplary medium processing apparatus includes a binding processing controller 102 and a binding processor 101. The binding processing controller 102 receives an instruction for processing from the image formation controller 308 of the MFP 1 through a communication line 309. The binding processor 101 performs the specified processing to the specified sheet S.

The image formation controller 308 and the binding processing controller 102 coupled through the communication line 309 can exchange information. Thus, information regarding operation mode, information regarding the size of sheets S, or information regarding timing is exchanged, enabling a systematic operation.

Figure 4:
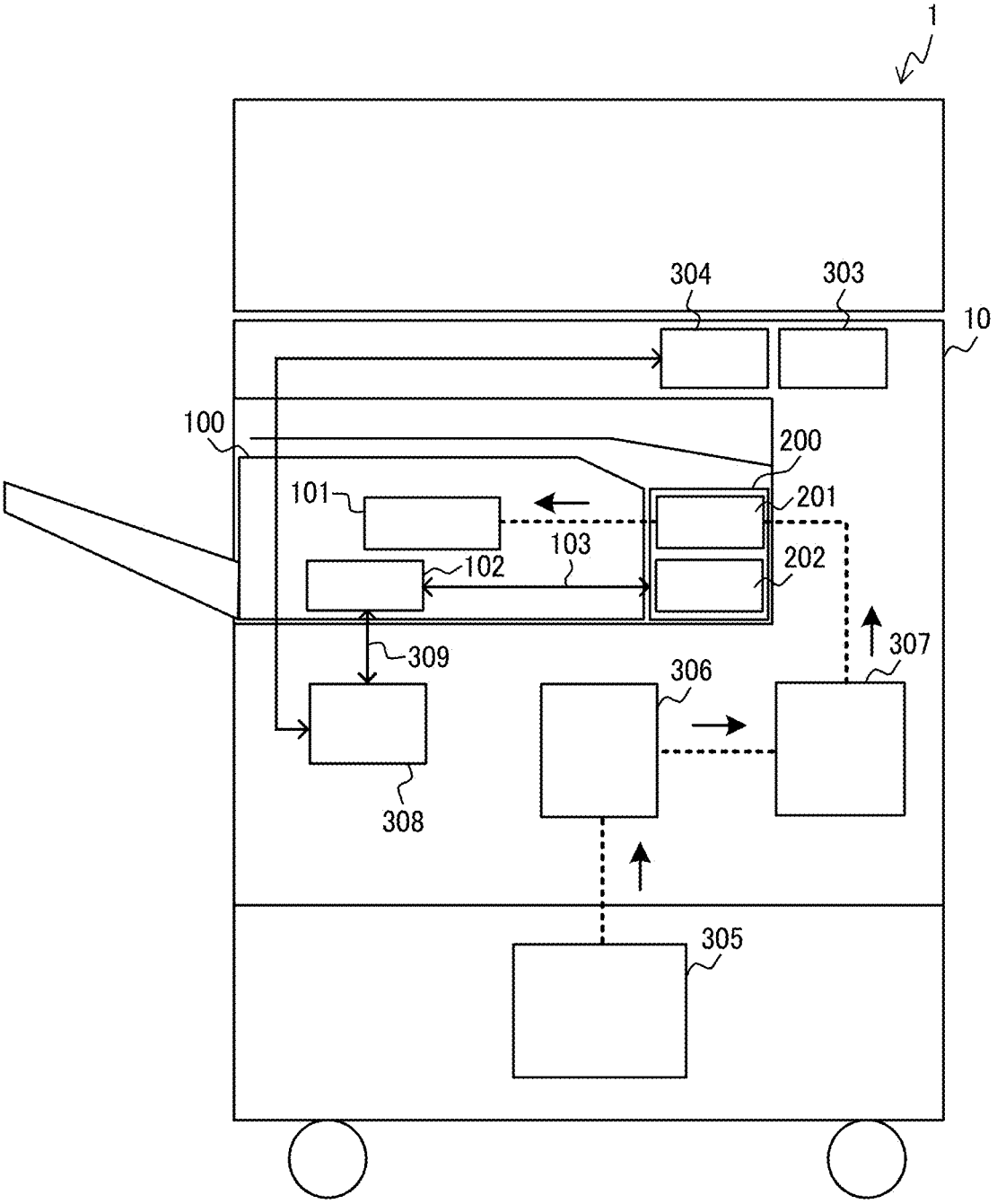
FIG. 4 is a functional block diagram corresponding to the exemplary MFP according to the present embodiment.

FIG. 4 illustrates an exemplary control configuration of an MFP 1 to which a punching processing unit 200 is attached. Referring to FIG. 4, a conveyance path for sheets S (a flow of sheets S) is indicated with dashed arrows, and a path for communication signals (control signals) (flows of signals) is indicated with solid arrows.

Similarly, the MFP 1 includes a display 303, an operation device 304, and a sheet feeding device 305. Similarly, the MFP 1 further includes an imaging device 306 and an image formation controller 308.

A binding processing unit 100 as an exemplary medium processing apparatus includes a binding processing controller 102 and a binding processor 101. The binding processing controller 102 receives an instruction for processing from an image formation controller 308 of the MFP 1 through a communication line 309. The binding processor 101 performs the specified processing to the specified sheet S. The binding processor 101 is notified of specification information regarding processing details to a sheet S through a punching processor 201.

The image formation controller 308 and the binding processing controller 102 coupled through the communication line 309 can exchange information. Thus, information regarding operation mode, information regarding the size of sheets S, or information regarding timing is exchanged, enabling a systematic operation.

The punching processing unit 200 includes a punching processing controller 202 that receives an instruction from the binding processing controller 102 through a communication line 103 after the image formation controller 308 of the MFP 1 issues an instruction for processing to the binding processing controller 102 through the communication line 309. The punching processing controller 202 controls the punching processor 201 to perform the specified punching processing.

Hardware Configuration of MFP

Figure 5:
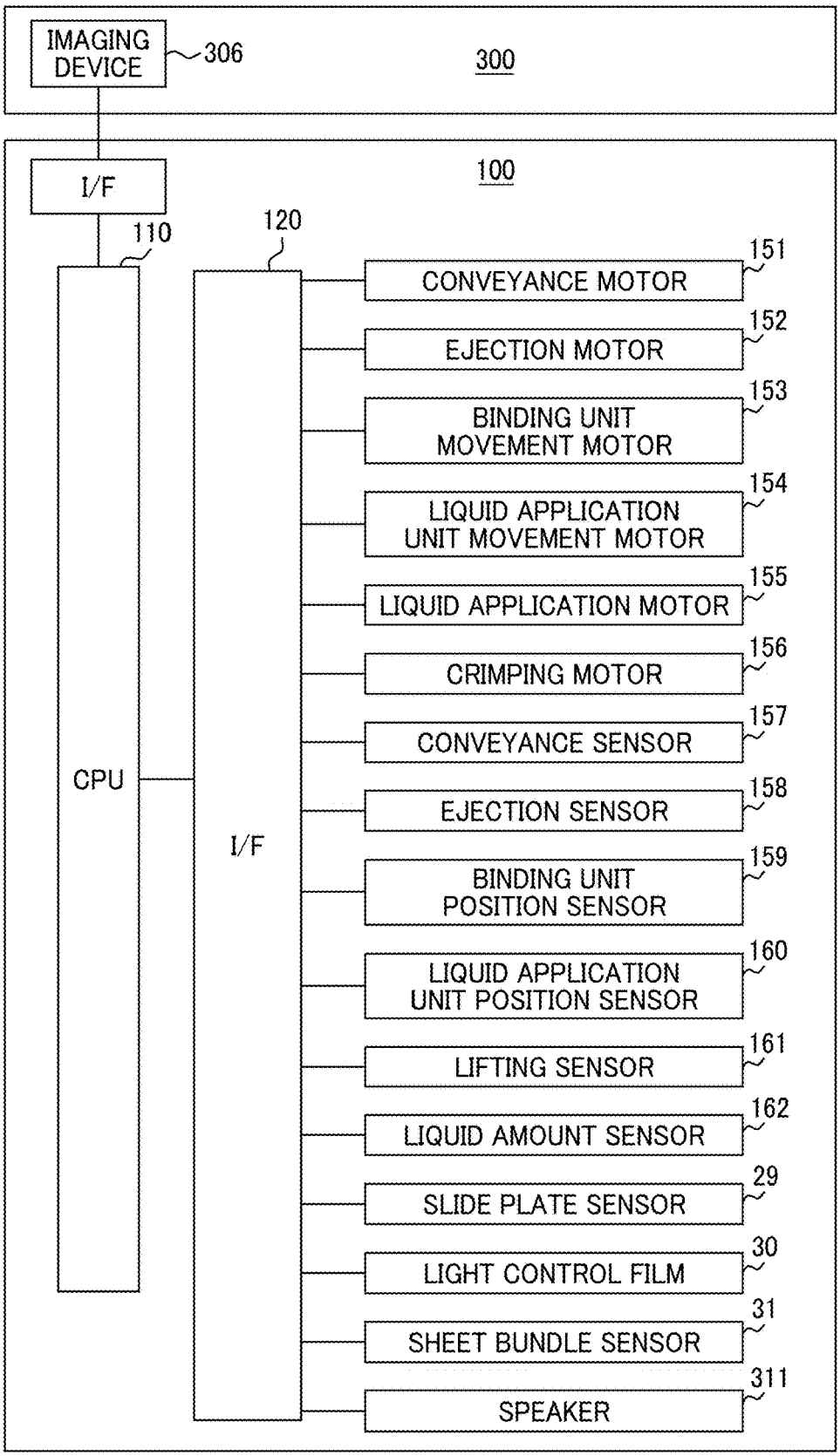
FIG. 5 is a functional block diagram of a binding processing unit according to the present embodiment.

Next, a hardware configuration of the binding processing unit 100 included in an MFP 1 will be described with FIG. 5. Note that no description of a hardware configuration including a punching processing unit 200 will be given. As illustrated in FIG. 5, the binding processing unit 100 includes a central processing unit (CPU) 110 as a controller connected, through an interface (I/F) 120, to a plurality of motors as power sources for the operations of mechanisms. The CPU 110 serves as an arithmetic means and controls the entire operation of the binding processing unit 100.

The CPU 110 in the binding processing unit 100 is connected to the image formation controller 308 of the MFP 1 through the I/F 120 and controls the binding processing unit 100 in response to a processing signal from the MFP 1. The binding processing unit 100 is an optional device and thus has a detachably attachable hardware configuration.

Note that an I/F for connection between the image forming device 300 and the binding processing unit 100 includes, for example, a relay connector or a drawer connector that enables a detachably attachable hardware configuration. Note that an I/F for connection between the punching processing unit 200 and the image forming device 300 has a similar configuration.

Drive motors that drive a plurality of conveyance roller pairs for binding processing in the binding processing unit 100 are each equipped with an encoder enabling detection of the amount of driving of the corresponding motor based on the number of pulses. Therefore, each conveyance roller pair can drive or stop at a position corresponding to a particular amount of driving with a particular timing as the base point, leading to implement of control of conveying a sheet S by a predetermined amount in a predetermined direction.

The amount of driving of each motor can be calculated based on the pulses of the corresponding encoder measured with the timing at which a sensor on the conveyance path is turned ON or OFF as the base point. Then, based on the calculated amount of driving of each motor, the position of an end of the sheet S being conveyed can be detected.

As exemplified in FIG. 5, the binding processing unit 100 includes a conveyance motor 151, an ejection motor 152, a binding unit movement motor 153, a liquid application unit movement motor 154, a liquid application motor 155, a crimping motor 156, a conveyance sensor 157, an ejection sensor 158, a binding unit position sensor 159, a liquid application unit position sensor 160, a lifting sensor 161, a liquid amount sensor 162, a slide plate sensor 29, a light control film 30, a sheet bundle sensor 31, and a speaker 311 that are connected to the CPU 110 through the I/F 120.

Configuration of Binding Processing Unit

Figure 6A:
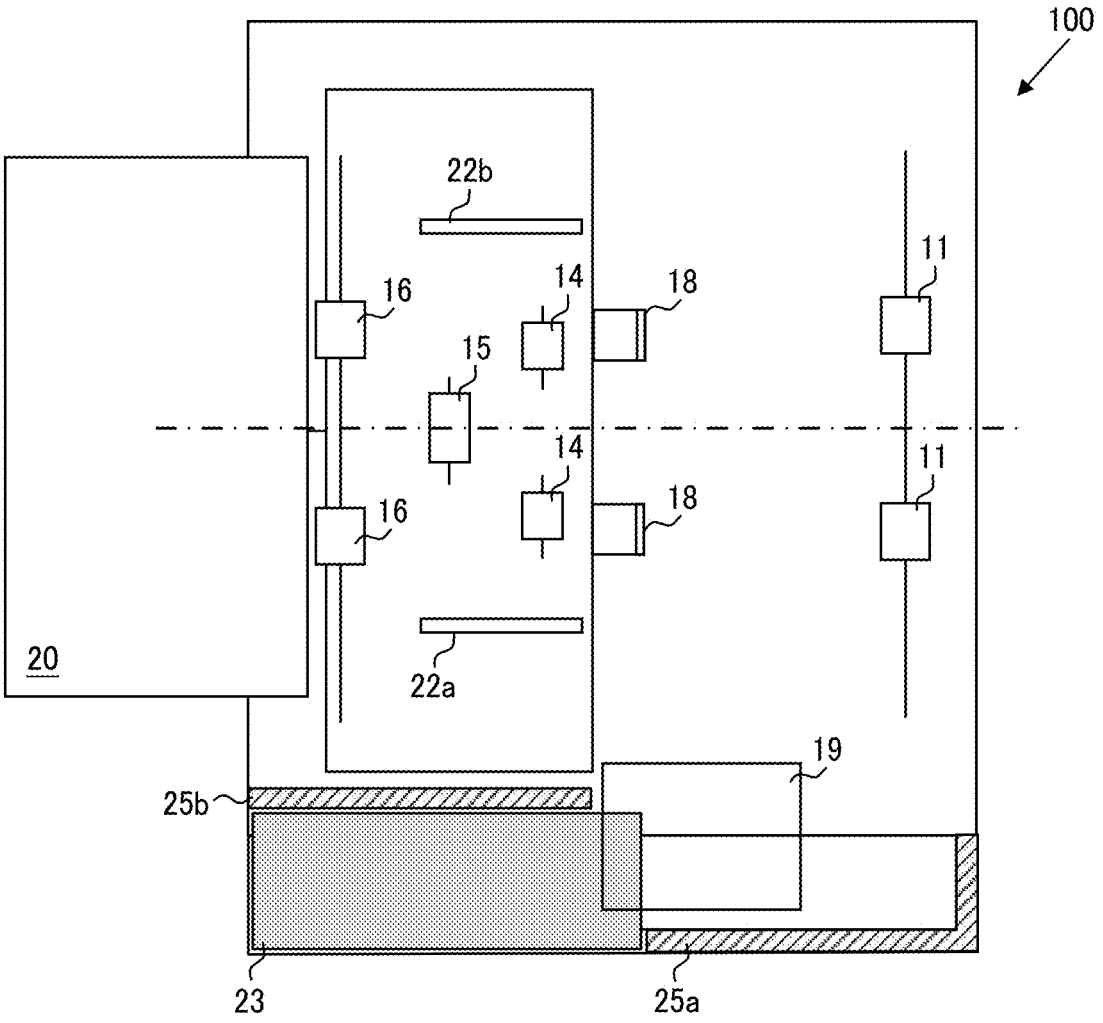
FIGS. 6A and 6B are schematic views of an exemplary fundamental configuration of the binding processing unit according to the present embodiment.
Figure 6B:
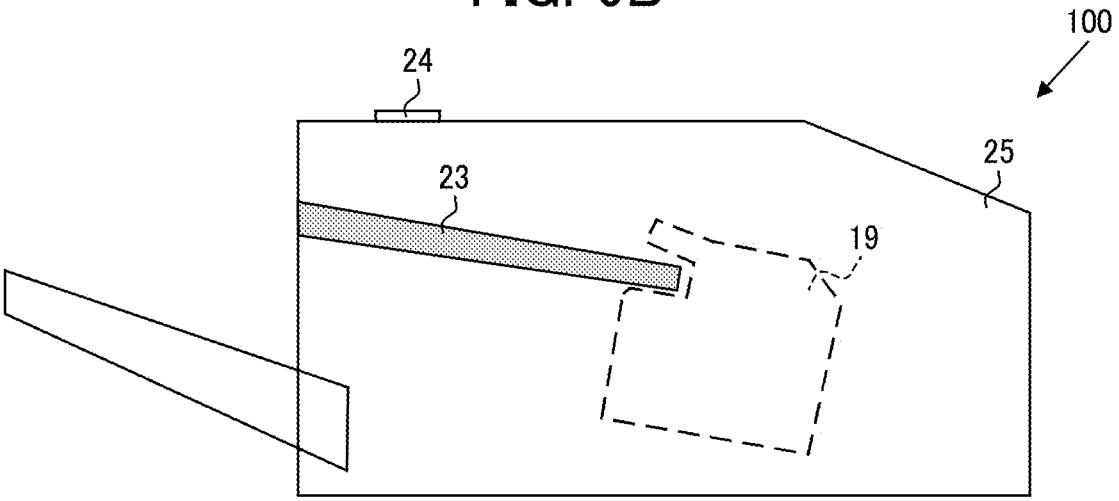

Next, the configuration of the binding processing unit 100 according to the present embodiment will be described with reference to the drawings. FIG. 6A is a plan view of the binding processing unit 100. FIG. 6B is a cross-sectional view of the binding processing unit 100. Referring to FIGS. 6A and 6B, the binding processing unit 100 includes a stapling unit 19 for "stapling" that binds an end of a sheet bundle with a staple.

Figure 7A:
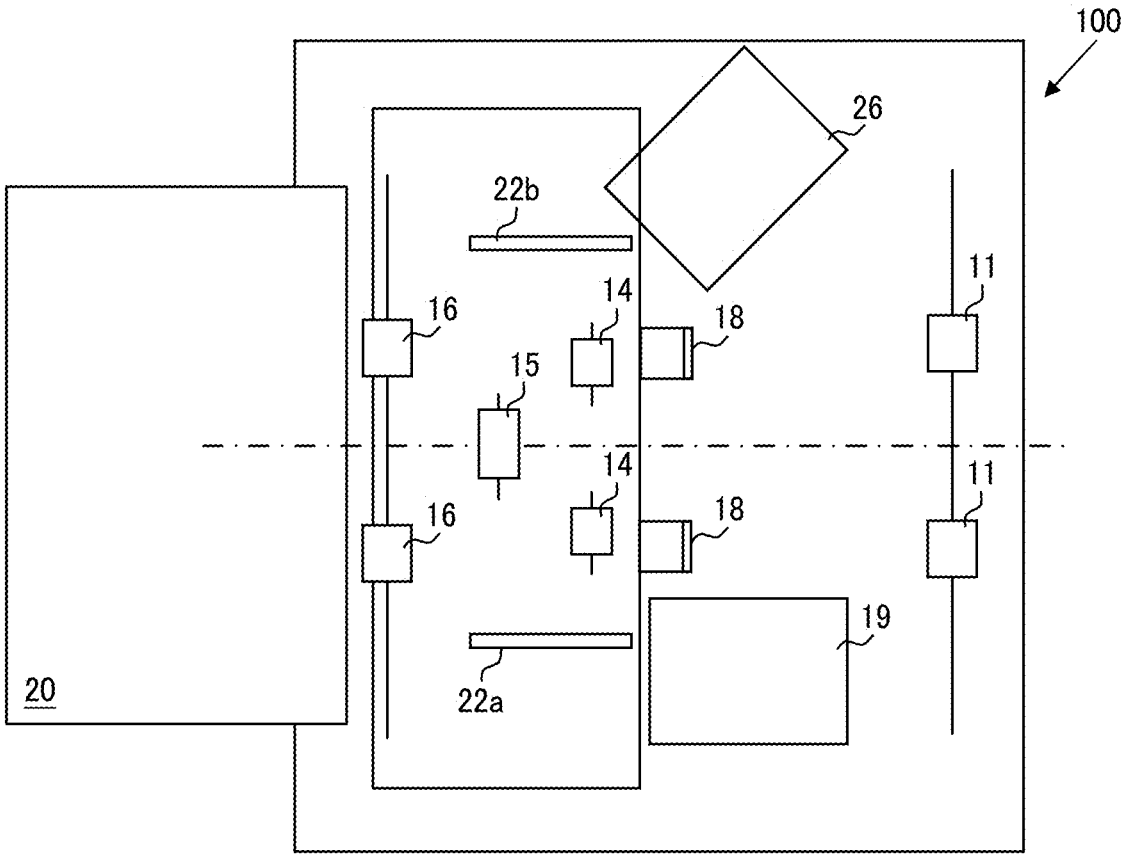
FIGS. 7A and 7B are schematic views of another exemplary fundamental configuration of the binding processing unit according to the present embodiment.
Figure 7B:
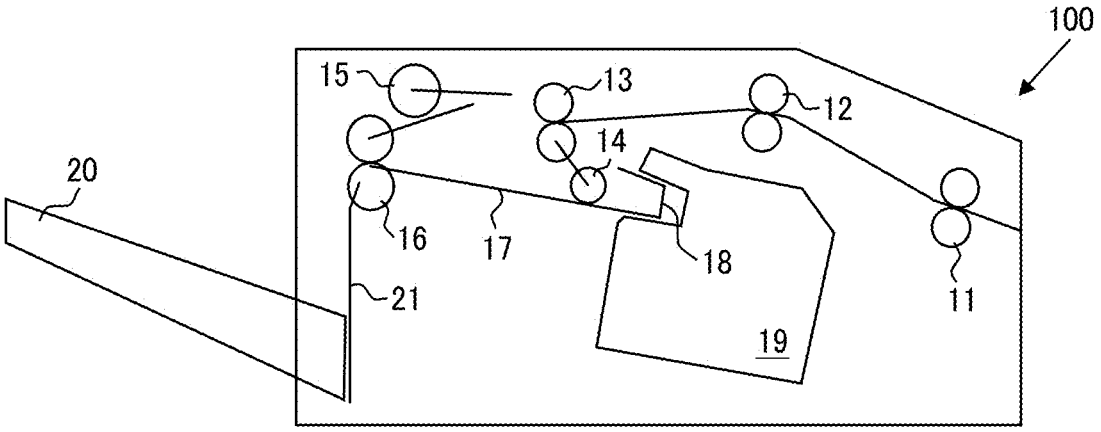

Note that, as described later, a binding unit available for manual binding processing in the binding processing unit 100 is not limited to the stapling unit 19. Used can be a crimp binding unit 26 that can perform crimp binding, that is, deforms part of a sheet bundle Sb by pressure to bind the sheet bundle Sb with no staple. Then, as exemplified in FIGS. 7A and 7B, provided can be a binding processing unit 100 having a hybrid configuration including a stapling unit 19 and a crimp binding unit 26.

Figure 8A:
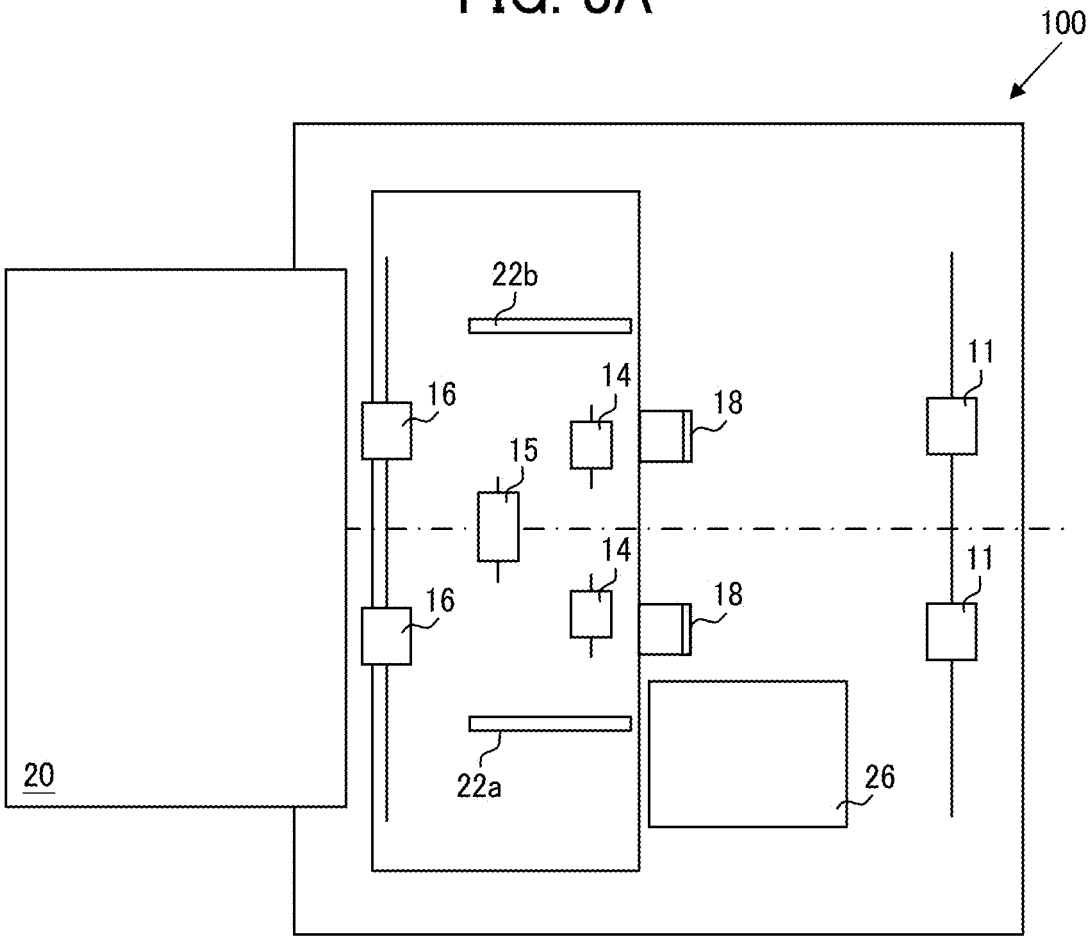
FIGS. 8A and 8B are schematic views of another exemplary fundamental configuration of the binding processing unit according to the present embodiment.
Figure 8B:
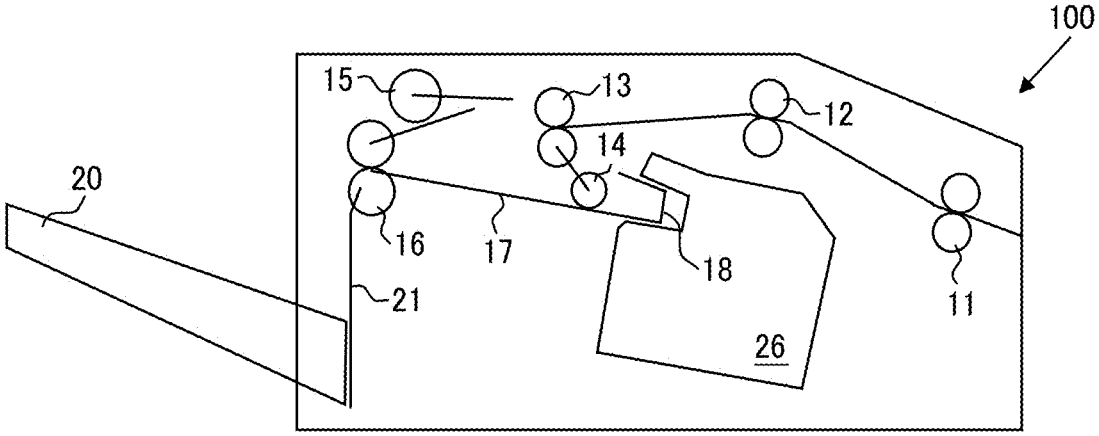

As exemplified in FIGS. 8A and 8B, provided is a binding processing unit 100 including a crimp binding unit 26 for "crimp binding" that deforms an end of a sheet bundle Sb by pressure with no staple to bind the sheet bundle Sb.

That is, the following exemplified binding processing unit 100 may be any of a binding processing unit 100 including a stapling unit 19 with no crimp binding unit 26, a binding processing unit 100 including a crimp binding unit 26 with no stapling unit 19, and a binding processing unit 100 having a hybrid configuration including a stapling unit 19 and a crimp binding unit 26.

As illustrated in FIG. 6B, a housing that houses the constituents of the binding processing unit 100 has an outer cover 25 (part of the housing) provided with a slit 23 for manual stapling. The slit 23 corresponds to a space into which a user can insert a sheet bundle Sb through an opening provided to part of the outer cover 25, and serves as a sheet inserter. Note that, referring to FIGS. 7A and 7B and FIGS. 8A and 8B, no illustration of a configuration for manual stapling processing including a slit 23 is given.

The binding processing unit 100 has a plurality of settable operation modes and appropriately operates based on the set operation mode. Examples of the operation modes that the binding processing unit 100 has include a "shift ejection mode" in which a sheet S is conveyed and ejected without being subjected to binding processing in the range of from the upstream side (image forming device 300) to an ejection tray 20 and a "binding mode" in which the stapling unit 19 or the crimp binding unit 26 performs binding processing to a sheet S.

In the shift ejection mode, the sheet S conveyed from the MFP 1 is received by an entrance roller 11 and then is conveyed to an ejection roller 16, followed by ejection of the sheet S to the ejection tray 20.

In the binding mode, the sheet S conveyed from the MFP 1 is received by the entrance roller 11 and then is conveyed to a shift roller 13 in a first direction. In response to passage of the sheet S through the shift roller 13, a tap roller 15 is driven to put the sheet S onto a stack tray 17 as an inner tray. After that, due to operations of the tap roller 15 and a return roller 14, the sheet S is conveyed to the rear end of the stack tray 17. In this case, the sheet S is conveyed to a reference fence 18 for alignment of respective ends of sheets S.

In the binding mode, such an operation of putting a sheet S on the stack tray 17 and then conveying the sheet S to the reference fence 18 as above is repeated until the number of sheets to be bound is fulfilled. Then, after the last sheet S is conveyed to the reference fence 18, a binding unit, such as the stapling unit 19 or the crimp binding unit 26, performs binding processing to bind an end of a bundle of sheets S (sheet bundle Sb). The bound sheet bundle Sb is ejected to the ejection tray 20 by the ejection roller 16.

Note that respective ends of sheets S or sheet bundles Sb ejected to the ejection tray 20 are hit against an end fence 21 for alignment.

When a user inserts a sheet bundle Sb into the slit 23 and then presses down a processing start button 24 provided to part of the outer cover 25 of the binding processing unit 100, stapling processing or crimp binding processing is performed. The processing start button 24 corresponds to an operation means that issues an instruction for starting manual binding processing.

The stapling unit 19 or the crimp binding unit 26 is allowed to have its home position (initial position) at the binding position in manual stapling. That is, as the home position, set can be a position corresponding to the binding position for a sheet bundle Sb when ends of the sheet bundle Sb are each hit against a hitting portion for sheet bundle positioning after a user inserts the sheet bundle Sb into the slit 23 for setting.

Note that, as a sheet bundle positioning configuration, for example, as exemplified in FIG. 6A, a conveyance direction stopper 25*a* and a width direction stopper 25*b* are provided. The conveyance direction stopper 25*a* serves as a portion for hitting in a direction corresponding to the conveyance direction at the time of ejection of a sheet bundle Sb. The width direction stopper 25*b* serves as a portion for hitting in a width direction orthogonal to the conveyance direction of a sheet S. The respective positions of the conveyance direction stopper 25*a* and the width direction stopper 25*b* are adjusted such that the sheet bundle Sb hit against the conveyance direction stopper 25*a* and the width direction stopper 25*b* after inserted in the slit 23 is located at the binding position. Then, the home position of the binding unit is set such that an end of the sheet bundle Sb hit against the conveyance direction stopper 25*a* and the width direction stopper 25*b* is set at the binding position. Due to such settings, manual stapling processing can be performed at the position where the binding unit starts to operate.

Note that, in the example of FIGS. 7A and 7B, the crimp binding unit 26 is disposed on the far side of the binding processing unit 100 and the stapling unit 19 is disposed on the near side of the binding processing unit 100, but this is not limiting. The stapling unit 19 may be disposed on the far side and the crimp binding unit 26 may be disposed on the near side.

In a case where the longitudinal side of the opening through which a sheet bundle Sb is inserted into the slit 23 is located on the near side, the "far side" in the present specification corresponds to the opposite side to the longitudinal side. That is, the "far side" corresponds to the upper side of the drawing of FIG. 7A when the viewer faces the drawing of FIG. 7A.

Binding Processing Unit According to First Embodiment

Figure 9A:
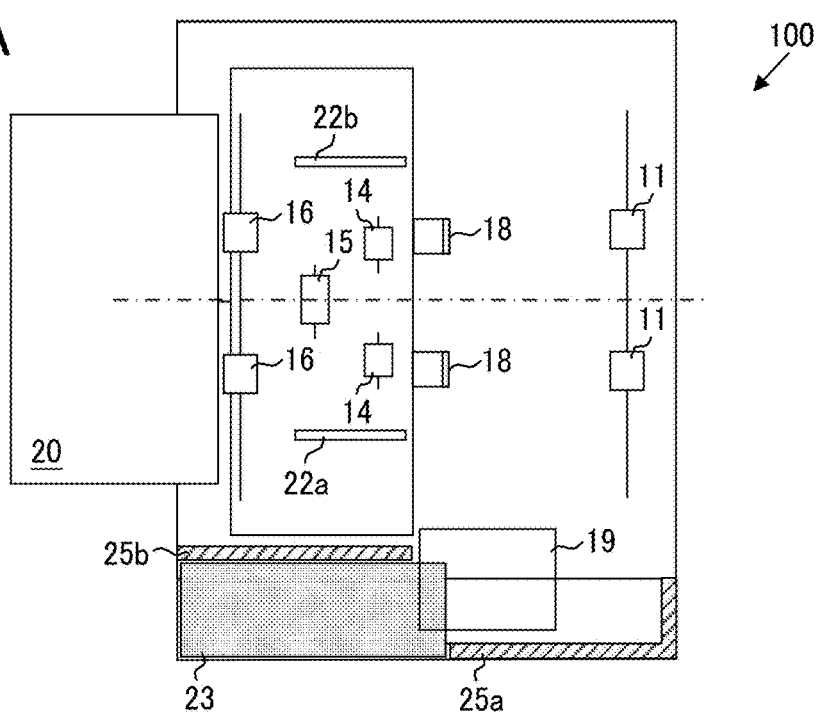
FIGS. 9A to 9C illustrate an exemplary distinctive configuration of a binding processing unit according to a first embodiment.

FIG. 9A is a plan view of a binding processing unit 100 and exemplifies a state where a stapling unit 19 is located at an end of a sheet bundle Sb that is hit against a conveyance direction stopper 25*a* and a width direction stopper 25*b* after the sheet bundle Sb is inserted in a slit 23, enabling manual binding processing to be immediately performed.

Figure 9B:
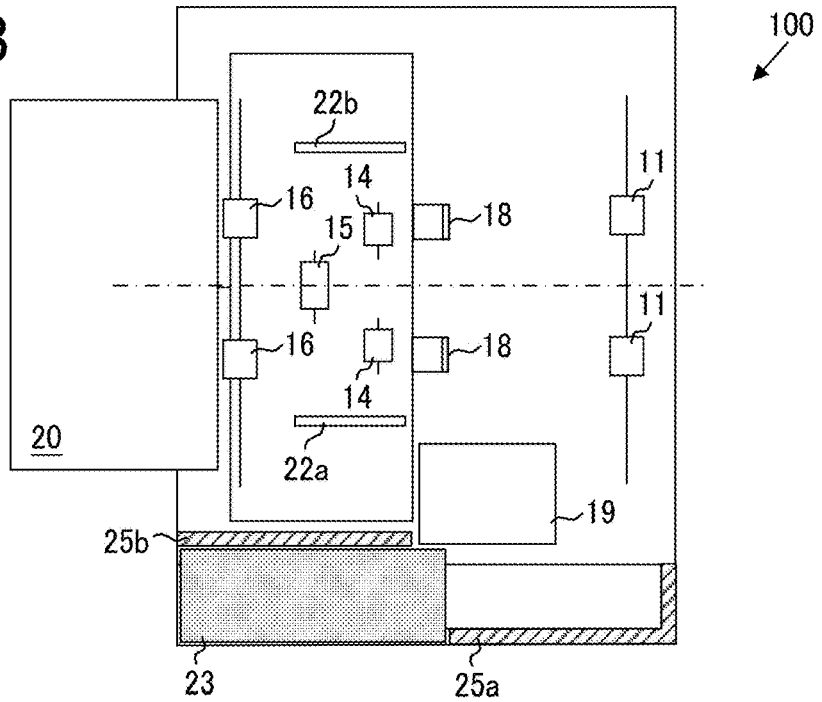

FIG. 9B exemplifies a state where the stapling unit 19 is located out of an end of a sheet bundle Sb that is hit against the conveyance direction stopper 25*a* and the width direction stopper 25*b* after the sheet bundle Sb is inserted in the slit 23. Thus, for manual binding processing, the stapling unit 19 needs to move to the binding position. That is, the state illustrated in FIG. 9B corresponds to a state where the stapling unit 19 has moved toward the far side of the binding processing unit 100.

Figure 9C:
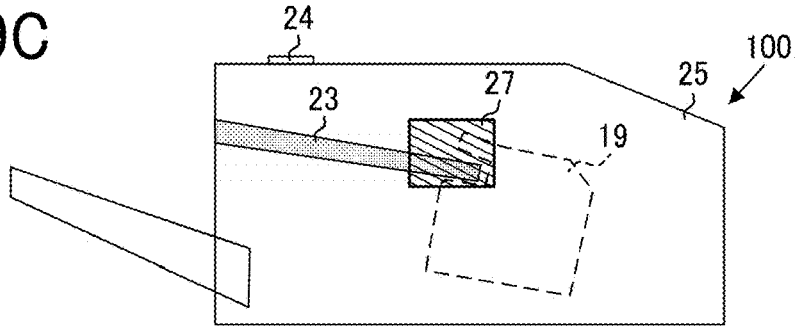

FIG. 9C is a front view of the binding processing unit 100 including an outer cover. A rectangular portion shaded in FIG. 9C corresponds to a transparent plate 27 as a verification outer cover that is a transparent member provided to part on the front side of the outer cover. The transparent plate 27 is a member enabling the state near the binding position in the slit 23 to be visually verified from outside an outer cover 25, and serves as a binding position verifier.

As exemplified in FIG. 9C, the transparent plate 27 is a member enabling advance visual verification of the binding position for a sheet bundle Sb on the near side (front side) of the binding processing unit 100 in a case where the stapling unit 19 can perform binding processing to the sheet bundle Sb.

Binding Processing Unit According to Second Embodiment

Figure 10A:
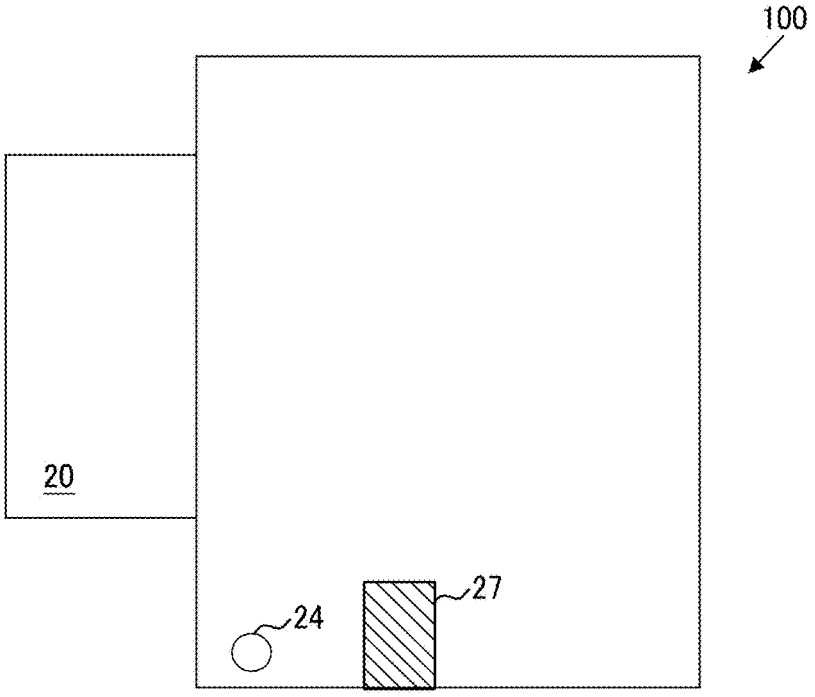
FIGS. 10A and 10B illustrate an exemplary distinctive configuration of a binding processing unit according to a second embodiment.
Figure 10B:
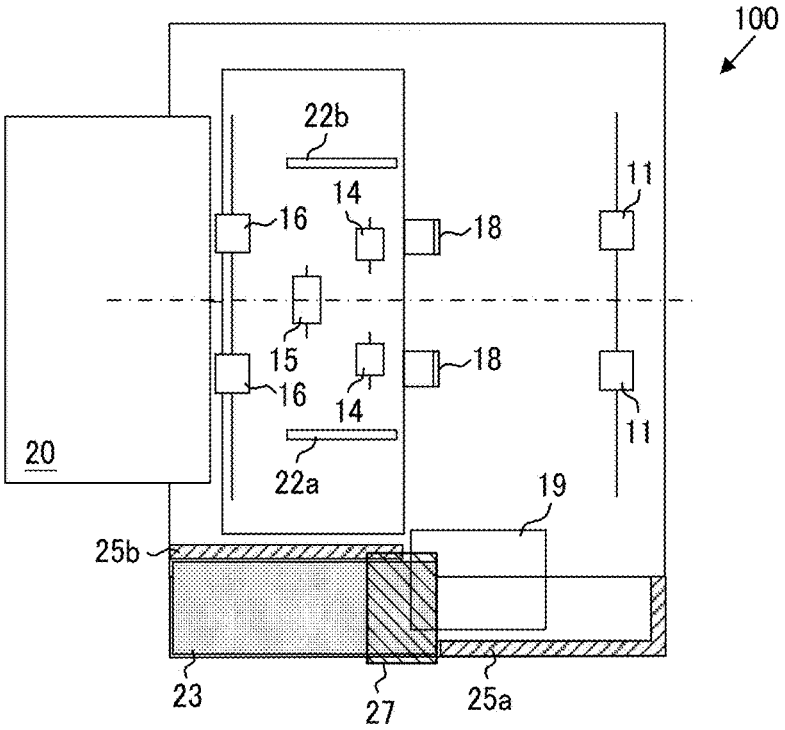

FIG. 10A is a bird's eye view of a binding processing unit 100 including an outer cover. FIG. 10B is a bird's eye view of the binding processing unit 100 viewed through the outer cover. As illustrated in FIGS. 10A and 10B, a transparent plate 27 is provided as part of the outer cover including the top face of the binding processing unit 100, so that the state near the binding position in a slit 23 can be verified from the top side of the binding processing unit 100.

Figure 11:
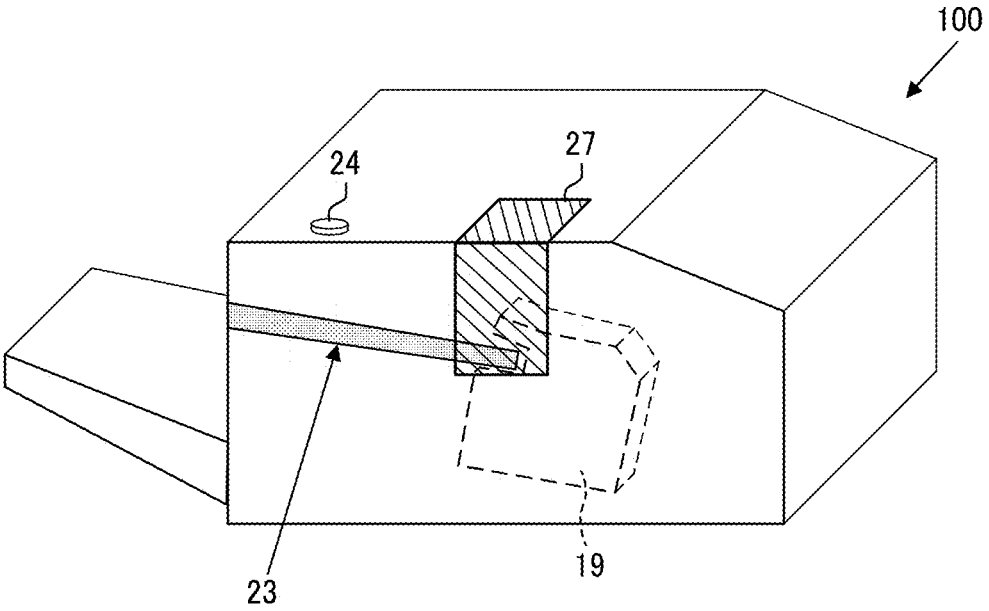
FIG. 11 illustrates the exemplary distinctive configuration of the binding processing unit according to the second embodiment.

FIG. 11 is a perspective view of the binding processing unit 100. As illustrated in FIG. 11, the transparent plate 27 as a verification outer cover ranges continuously from the top portion to a lateral portion of the outer cover of the binding processing unit 100 as a configuration, so that the position at which binding processing can be performed inside the slit 23 (performable position) can be visually verified from both the top side and the front side (lateral side). Thus, manual binding processing can be reliably performed with visual verification of the binding position for a sheet bundle Sb inserted in the slit 23.

Binding Processing Unit According to Third Embodiment

Figure 12:
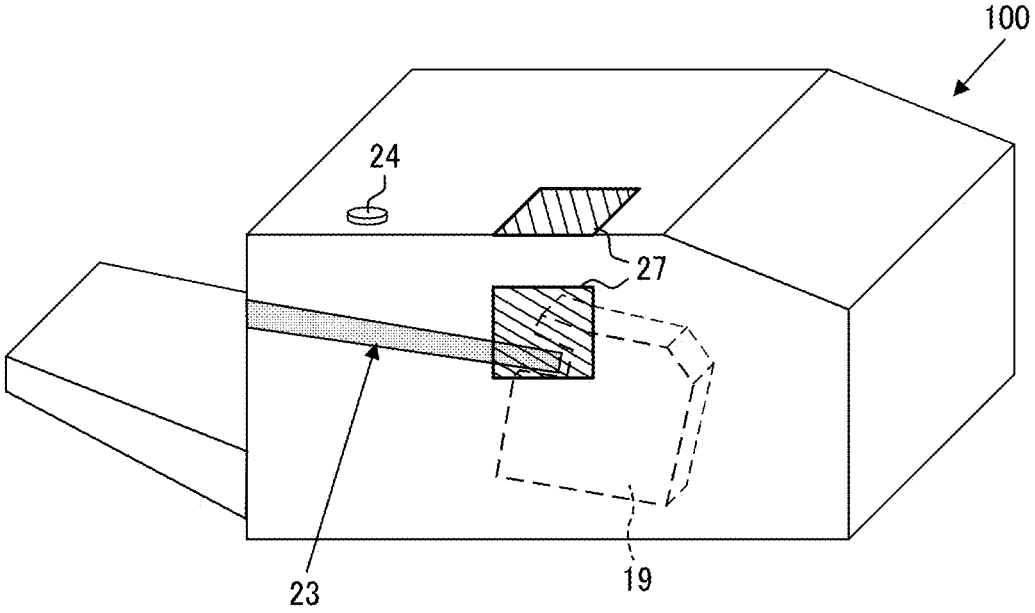
FIG. 12 illustrates an exemplary distinctive configuration of a binding processing unit according to a third embodiment.

FIG. 12 is a perspective view of a binding processing unit 100. As illustrated in FIG. 12, as a configuration, the binding processing unit 100 includes an outer cover having a top portion provided with a transparent plate 27 and a lateral portion provided with a transparent plate 27. Even with the configuration exemplified in FIG. 12, similarly to the exemplification in FIG. 11, the position at which binding processing can be performed inside a slit 23 (performable position) can be visually verified from both the top side and the front side (lateral side). Thus, manual binding processing can be reliably performed with visual verification of the binding position for a sheet bundle Sb inserted in the slit 23.

Note that, like the exemplifications in FIGS. 10A to 12, desirably, a transparent plate 27 is provided to part of the periphery of the opening of the slit 23 (to part of the periphery of a slit section). In a case where a transparent member including the entirety of the opening is provided and a sheet detector that optically detects insertion of a sheet bundle Sb is provided inside the slit 23 (on the far side of the slit 23), the sheet detector may be influenced by external light, leading to occurrence of misdetection. In contrast to this, such a transparent member in a minimum necessary range near the binding position as in the binding processing unit 100 according to the present embodiment enables prevention of the influence of external light.

Binding Processing Unit According to Fourth Embodiment

A binding processing unit 100 including a transparent plate 27 according to another embodiment will be described. For example, as exemplified in FIGS. 13A to 13C, for external visual verification of a position corresponding to the binding position on a sheet bundle Sb to be subjected to manual binding processing positioned after the sheet bundle Sb is inserted in a slit 23, a positional indicator is provided at a position overlapping the binding position on the transparent plate 27.

Figure 13A:
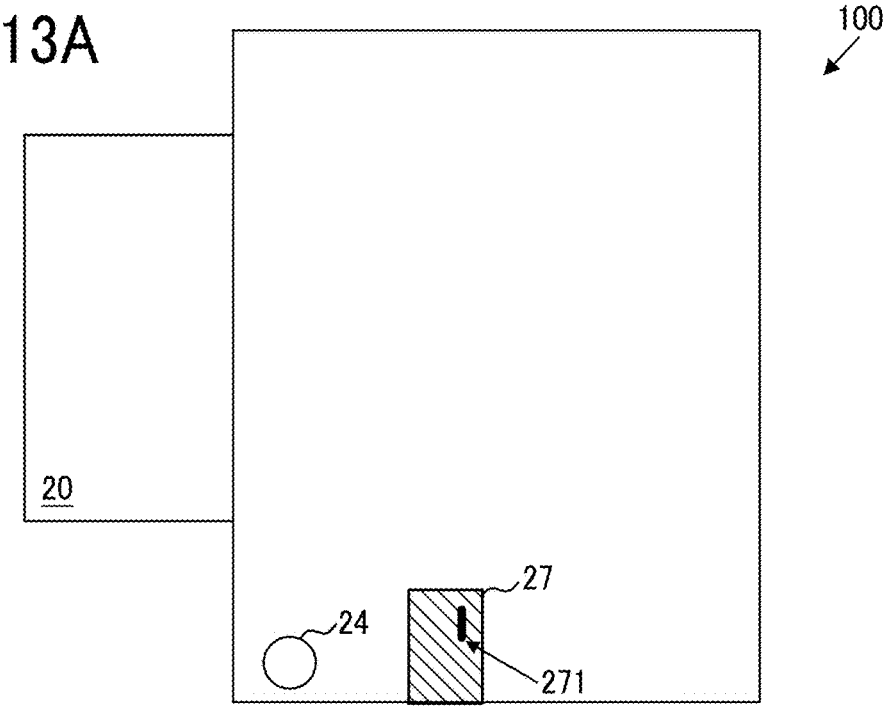
FIGS. 13A to 13C illustrate an exemplary distinctive configuration of a binding processing unit according to a fourth embodiment.

As exemplified in FIG. 13A, the top portion of the transparent plate 27 is provided with a marking 271 as the positional indicator. The marking 271 is a figure given to the transparent plate 27 and is indicated, for example, with a line segment along the binding position.

Figure 13B:
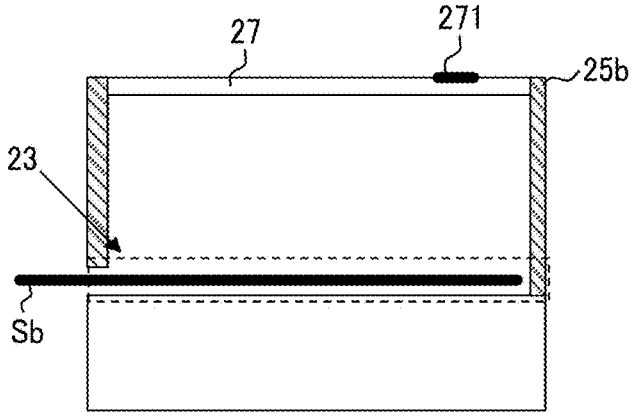

FIG. 13B is a cross-sectional view of the binding processing unit 100 viewed from right. As illustrated in FIG. 13B, the marking 271 is provided corresponding to the binding position for the sheet bundle Sb that is inserted in the slit 23 and has an end, in its width direction, hit against a width direction stopper 25*b*.

Figure 13C:
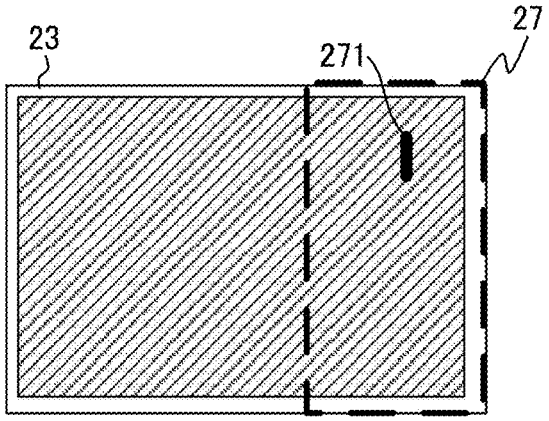

FIG. 13C is a bird's eye view of the slit 23 in which the sheet bundle Sb is inserted, with the marking 271 as the positional indicator provided to the top portion of the transparent plate 27. FIG. 13C illustrates a state where the sheet bundle Sb inserted in the slit 23 by a user to perform manual binding processing has hit against a conveyance direction stopper 25*a* and the width direction stopper 25*b*.

As illustrated in FIG. 13C, in a case where the sheet bundle Sb is positioned for manual binding processing, the marking 271 as the positional indicator indicating the binding position is present in the range in which visual verification can be performed from outside through the transparent plate 27 (in a rectangular region indicated with a dotted line in FIG. 13C). Therefore, in a case where a user to press down a processing start button 24 inserts a sheet bundle Sb in the slit 23 from the front side of the binding processing unit 100 and operates with the processing start button 24 in view from the upper side (top side), the user verifies the position of the marking 271 so as to look down at the binding position from above, so that the user can grasp the binding position in advance. That is, the position for binding processing (binding position) can be verified with visual verification of the overlap between the marking 271 and the sheet bundle Sb.

Note that, in a case where a binding unit (stapling unit 19 or crimp binding unit 26) is located in the range of the slit 23 (slit section) at the time of visual verification of the binding position, the binding unit results in an obstacle between the marking 271 and the sheet bundle Sb, so that advance verification of the binding position fails. Thus, at the time of visual verification of the binding position, like the exemplification in FIG. 9B, the binding unit is moved out of the slit, namely, toward the far side of the binding processing unit 100.

Binding Processing Unit According to Fifth Embodiment

A binding processing unit 100 including a transparent plate 27 provided with a marking 271 according to another embodiment will be described. For example, as exemplified in FIGS. 14A to 14D, the marking 271 can be changed depending on the type of binding processing.

Figure 14A:
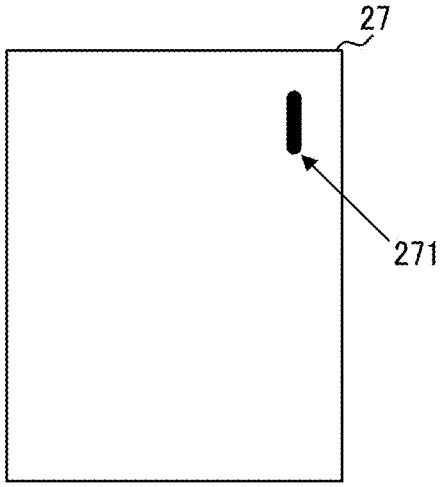
FIGS. 14A to 14D illustrate exemplary positional indicators corresponding to a binding processing unit according to a fifth embodiment.

A plurality of types of binding processing including stapling processing (binding processing with a staple) and crimp binding processing (binding processing with no staple) is performable in the binding processing unit 100. For example, as illustrated in FIG. 14A, for "end binding", namely, binding along an end of a sheet bundle Sb, provided is a marking 271 indicated with a line segment along the rectangle of a transparent plate 27.

Figure 14B:
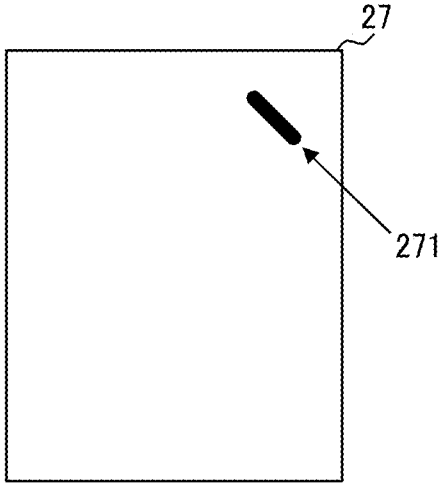

As illustrated in FIG. 14B, for "oblique binding", namely, binding at a position at an angle to an end of a sheet bundle Sb, provided is a marking 271 indicated with a line segment at an angle to an end of the rectangle of a transparent plate 27.

Figure 14C:
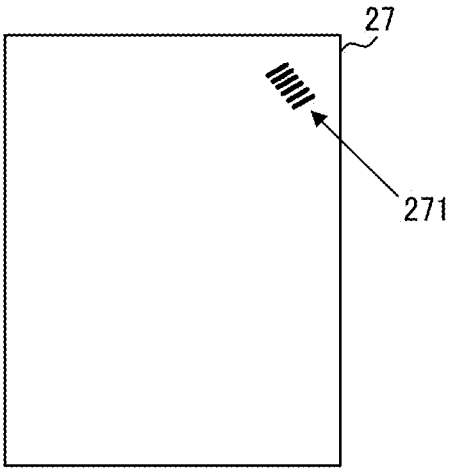

As illustrated in FIG. 14C, for crimp binding, provided is a marking 271 indicating portions to be crimped as line segments.

Figure 14D:
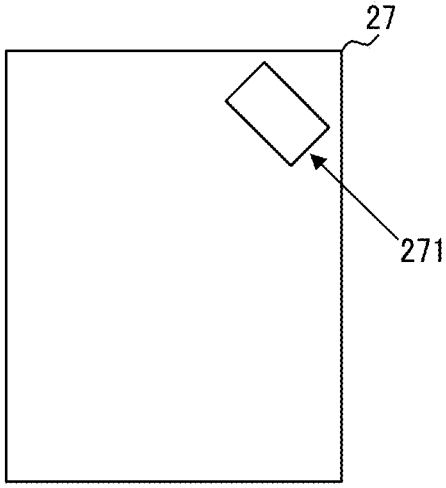

Note that, regardless of any type of binding processing or any binding method, as illustrated in FIG. 14D, provided can be a marking 271 indicating a range for a plurality of types of binding processing as a rectangle.

Binding Processing Unit According to Sixth Embodiment

A binding processing unit 100 including a transparent plate 27 provided with a marking 271 according to another embodiment will be described. For example, a marking 271 can be provided to such a transparent plate 27 as exemplified in FIG. 11 or one of such transparent plates 27 as exemplified in FIG. 12.

Figure 15A:
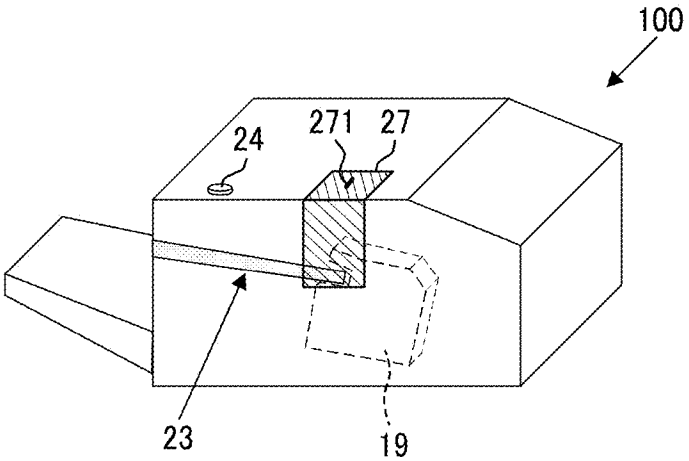
FIGS. 15A to 15D illustrate examples of installation of a positional indicator to a binding processing unit according to a sixth embodiment.
Figure 15B:
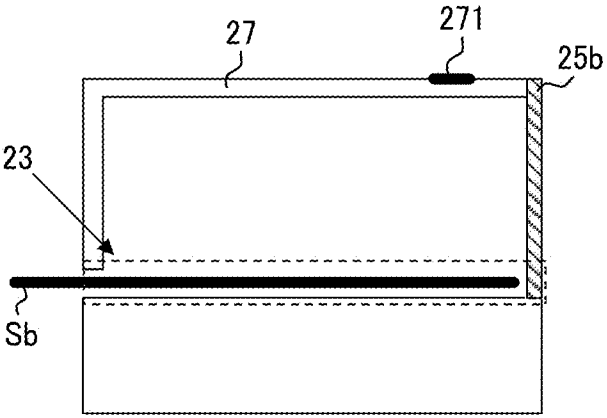

Referring to FIG. 15A, as an example, a marking 271 is provided to such a transparent plate 27 as exemplified in FIG. 11. FIG. 15B is a lateral cross-sectional view corresponding to FIG. 15A.

Figure 15C:
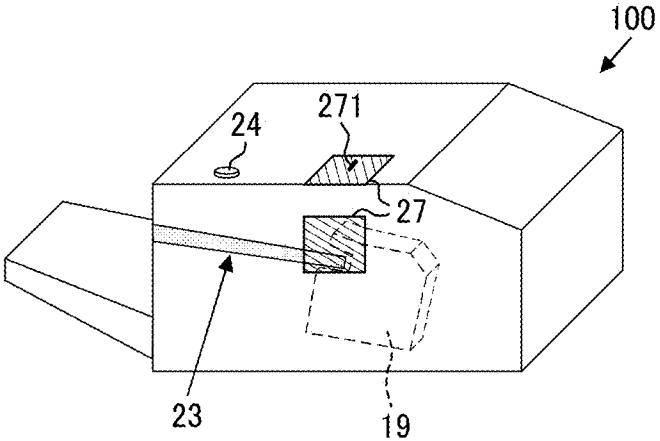
Figure 15D:
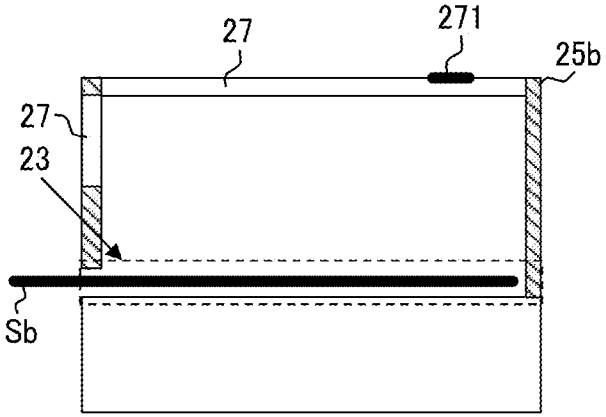

Referring to FIG. 15C, as an example, a marking 271 is provided to one of such transparent plates 27 as exemplified in FIG. 12. FIG. 15D is a lateral cross-sectional view corresponding to FIG. 15C.

In each case, the marking 271 is present as a positional indicator indicating the binding position in the range in which visual verification can be performed from outside through the transparent plate 27 with a sheet bundle Sb positioned for manual binding processing. Therefore, in a case where a user to press down a processing start button 24 inserts a sheet bundle Sb in a slit 23 from the front side of the binding processing unit 100 and operates with the processing start button 24 in view from the upper side (top side), the user can visually verify the inside of the slit 23 so as to look down at the binding position from above. That is, the position for binding processing (binding position) can be verified with visual verification of the overlap between the marking 271 and the sheet bundle Sb.

Binding Processing Unit According to Seventh Embodiment

A binding processing unit 100 including a transparent plate 27 provided with a marking 271 according to another embodiment will be described. For example, as exemplified in FIGS. 16A and 16B, a marking 271 can be provided to one of such transparent plates 27 as exemplified in FIG. 12, namely, to a transparent plate 27 in a lateral portion.

Figure 16A:
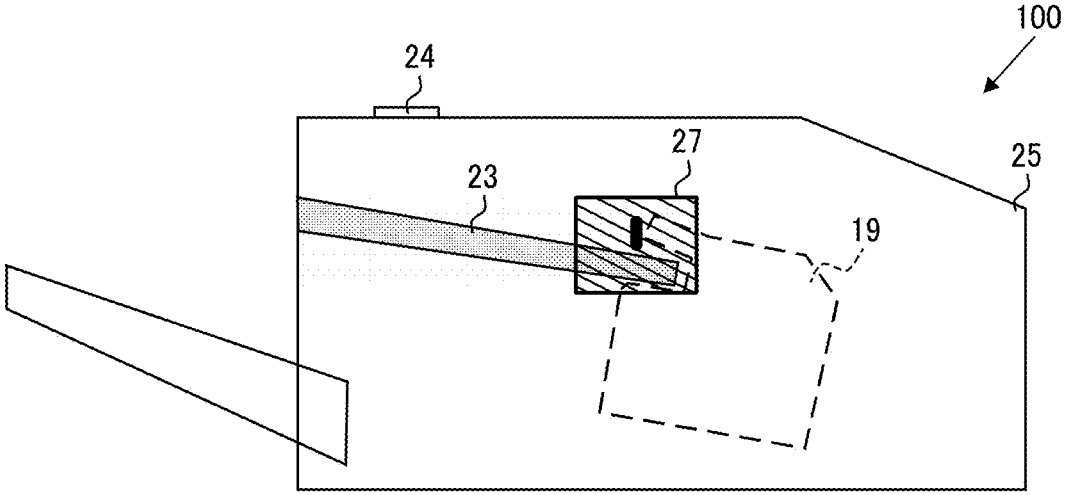
FIGS. 16A and 16B illustrate an example of installation of a positional indicator to a binding processing unit according to a seventh embodiment.

As illustrated in FIG. 16A, due to the marking 271 to the lateral transparent plate 27, the position at which a binding unit (stapling unit 19 or crimp binding unit 26) performs binding processing to a sheet bundle Sb inserted in a slit 23 can be visually verified in the width direction of the sheet bundle Sb.

Thus, a user can easily visually verify which position inward from an end of a sheet bundle Sb corresponds to the binding position.

Figure 16B:
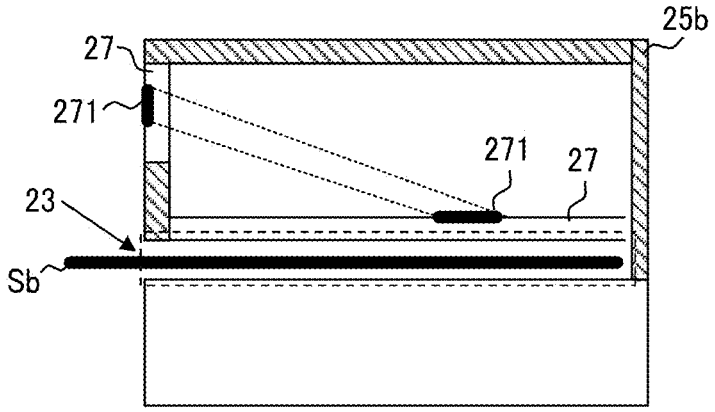

Note that, in a case where a marking 271 is provided to the transparent plate 27 on the lateral side, preferably, the angle at which the user looks in at the transparent plate 27 is specified such that the marking 271 correctly overlaps the binding position for the sheet bundle Sb. Thus, as illustrated in FIG. 16B, in addition to the marking 271 on the transparent plate 27 on the lateral side, a marking 271 is provided to a transparent plate 27 for part of the top of the slit 23. In a case where the marking 271 provided to the transparent plate 27 on the top side of the slit 23 and the marking 271 provided to the transparent plate 27 on the lateral side overlap in visual verification of the binding position from the lateral side, the angle in the viewing is correct. Thus, the binding position can be prevented from being visually verified from a wrong position (at a wrong angle).

Binding Processing Unit According to Eighth Embodiment

A binding processing unit 100 including a transparent plate 27 provided with a marking 271 according to another embodiment will be described. For example, a marking 271 can be provided to the lateral portion of such a transparent plate 27 as exemplified in FIG. 11 or to such a transparent plate 27 on the lateral side as exemplified in FIG. 12, like the marking 271 described with FIG. 16A.

Figure 17A:
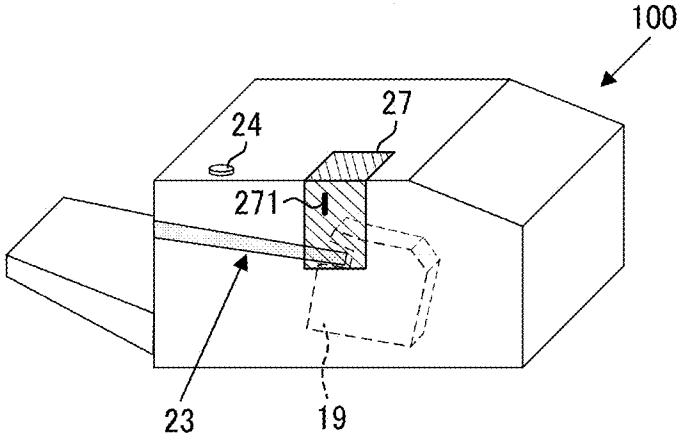
FIGS. 17A to 17D illustrate examples of installation of a positional indicator to a binding processing unit according to an eighth embodiment.
Figure 17B:
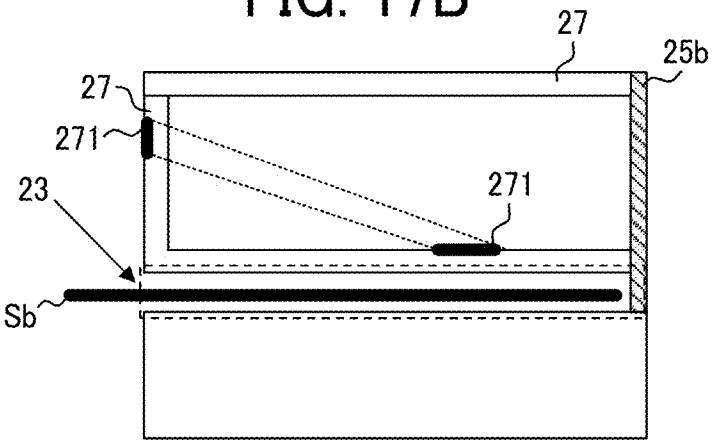

Referring to FIG. 17A, as an example, a marking 271 is provided to the lateral side of such a transparent plate 27 as exemplified in FIG. 11. FIG. 17B is a lateral cross-sectional view corresponding to FIG. 17A.

Figure 17C:
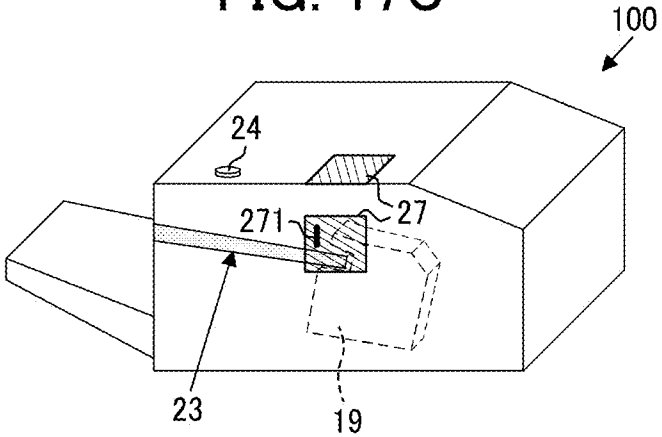
Figure 17D:
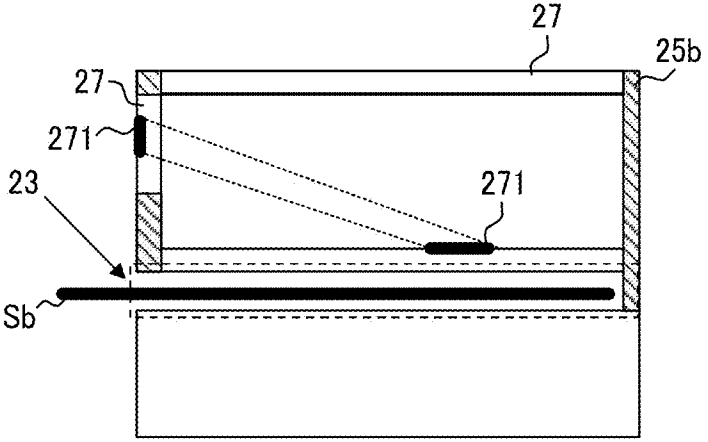

Referring to FIG. 17C, as an example, a marking 271 is provided to such a transparent plate 27 on the lateral side as exemplified in FIG. 12. FIG. 17D is a lateral cross-sectional view corresponding to FIG. 17C.

In each case, the marking 271 is present as a positional indicator indicating the binding position in the range in which visual verification can be performed from outside through the transparent plate 27 with a sheet bundle Sb positioned for manual binding processing. Therefore, in a case where a user to press down a processing start button 24 inserts a sheet bundle Sb in a slit 23 from the front side of the binding processing unit 100 and operates the processing start button 24 above the slit 23 while visually verifying the inside of the slit 23 from the lateral side (front side), the user can visually verify the inside of the slit 23, laterally.

In this case, the angle at which the user looks in at the transparent outer cover needs specifying such that the marking 271 on the transparent plate 27 on the lateral side correctly overlaps the binding position for the sheet bundle Sb. Thus, as illustrated in FIG. 17B or 17D, in addition to the marking 271 on the transparent plate 27 on the lateral side, a marking 271 is provided to a transparent outer cover for the top of the slit 23. The marking 271 on the top side of the slit 23 is provided such that the marking 271 on the top side of the slit 23 overlaps a position corresponding to the binding position in viewing at the correct angle through the marking 271 on the lateral side. Thus, the binding position can be prevented from being visually verified from a wrong position (at a wrong angle). The position for binding processing (binding position) can be verified with visual verification of the overlap between the markings 271 and the sheet bundle Sb.

The verification outer cover includes the positional indicator on a lateral wall of the verification outer cover. The binder is bindable the multiple sheets at multiple binding positions having the binding position, the verification outer cover includes multiple positional indicators including the positional indicator, and the multiple positional indicators respectively disposed at the multiple binding positions. The binder binds the multiple sheets with multiple types of bindings, and the binder changes the multiple types of bindings in response to types of the multiple positional indicators.

Binding Processing Unit According to Ninth Embodiment

Figure 18A:
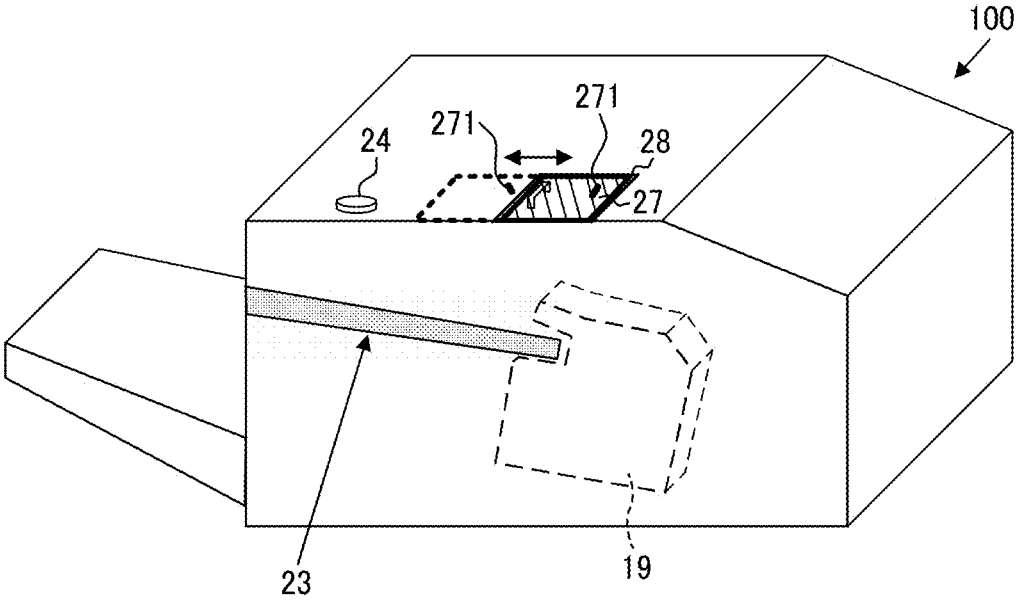
FIGS. 18A and 18B illustrate a configuration of switching between positional indicators of a binding processing unit according to a ninth embodiment.
Figure 18B:
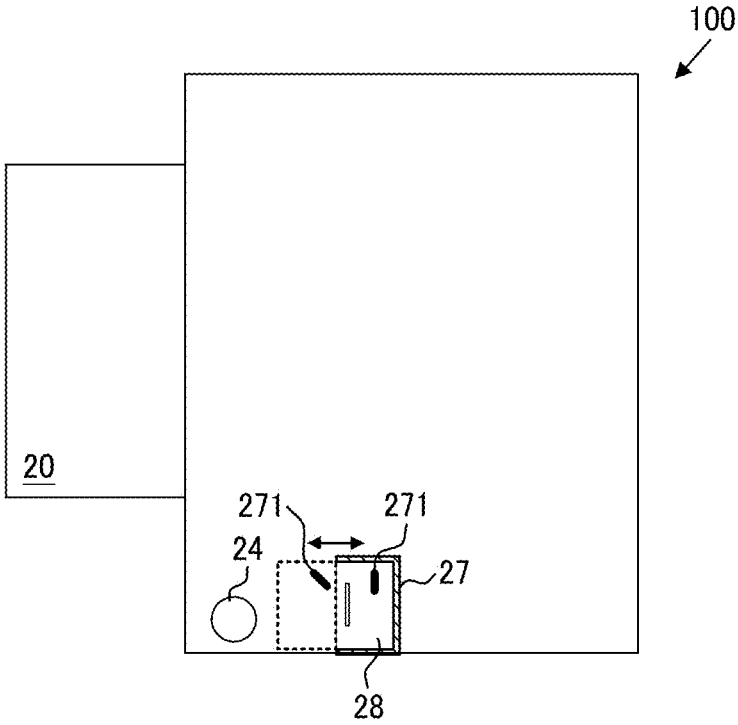

Next, a binding processing unit 100 according to another embodiment will be described. FIG. 18A is a perspective view of the binding processing unit 100 according to the present embodiment. FIG. 18B is a plan view of the binding processing unit 100 according to the present embodiment.

As illustrated in FIGS. 18A and 18B, provided is a transparent slide plate 28 that slides with respect to a transparent plate 27 as a verification outer cover. Then, the transparent slide plate 28 is provided with a plurality of markings 271 indicating binding positions corresponding one-to-one to different manners for binding processing.

For example, according to the exemplification in FIGS. 18A and 18B, the transparent slide plate 28 is provided with a marking 271 for end binding and a marking 271 for oblique binding.

Figure 19A:
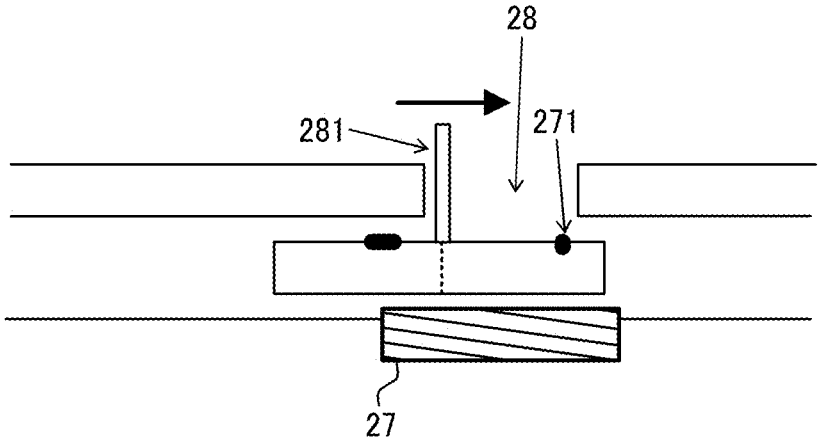
FIGS. 19A to 19C are explanatory views for the configuration of switching between positional indicators of the binding processing unit according to the ninth embodiment.
Figure 19B:
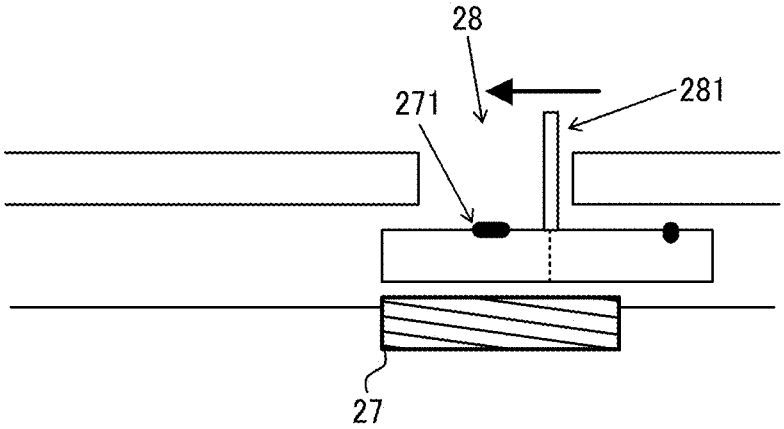
Figure 19C:
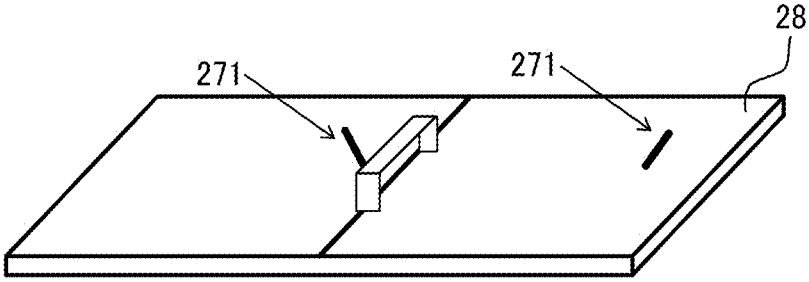

FIGS. 19A and 19B are cross-sectional views of the transparent slide plate 28 according to the present embodiment. FIG. 19C is a perspective view of the transparent slide plate 28 according to the present embodiment. As illustrated in FIGS. 19A to 19C, the transparent slide plate 28 is a plate-shaped transparent member including a grip 281 enabling a user to manually slide the transparent slide plate 28. A user slides the transparent slide plate 28 with respect to the transparent plate 27 while gripping the grip 281, leading to a change to a marking 271 that corresponds to the binding method and is one of the markings 271 with which the transparent slide plate 28 is provided.

That is, in the state illustrated in FIG. 19A, the marking 271 for end binding is located corresponding to the binding position. In the state illustrated in FIG. 19B, the marking 271 for oblique binding is located corresponding to the binding position.

Note that a method for a change to a marking 271 is not limited to a structure in which a plurality of markings 271 is provided and a positional change makes a change to one of the plurality of markings 271, like the transparent slide plate 28. For example, as illustrated in FIG. 20, a transparent plate 27 provided with a marking 271 may be detachably fittable by a snap-fit for free replacement.

Figure 20:
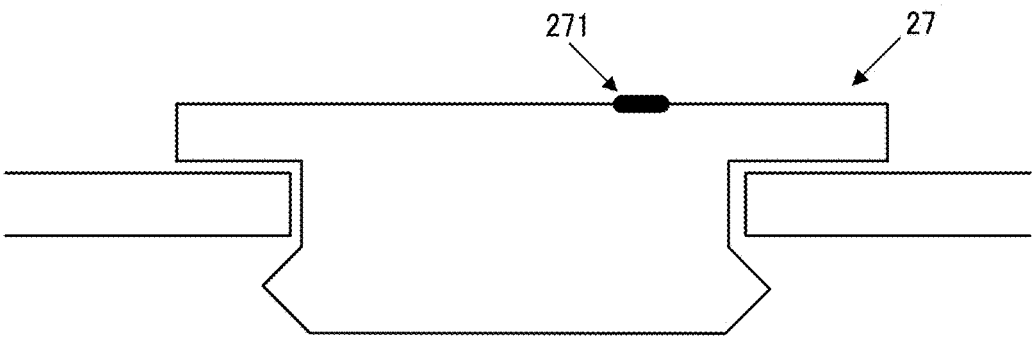
FIG. 20 illustrates an example of installation of a positional indicator to the binding processing unit according to the ninth embodiment.

In order to provide markings 271 at places, such a slidable transparent slide plate 28 as in the present embodiment may be used or a transparent plate 27 having such a structure as exemplified in FIG. 20 may be used.

The binding processing unit 100 according to the present embodiment enables use of a marking 271 corresponding to the manner for binding processing and enables the binding position to be visually verified from outside.

Binding Processing Unit According to Tenth Embodiment

Figure 21A:
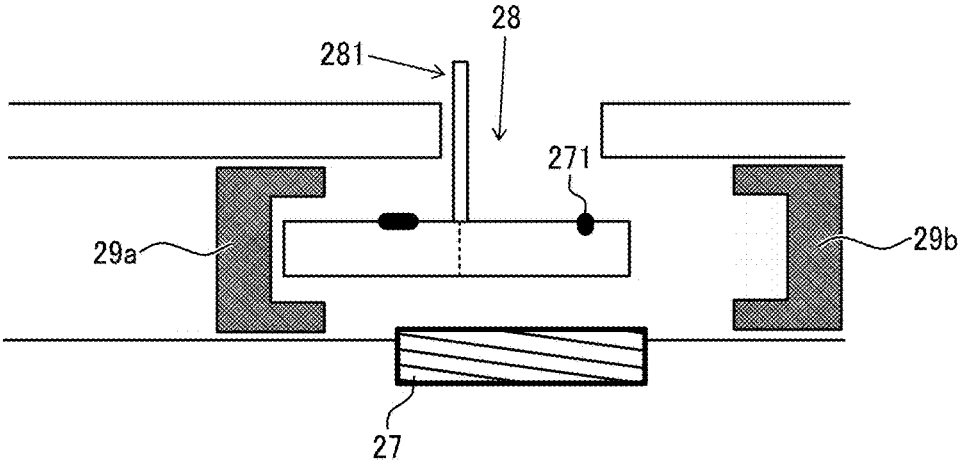
FIGS. 21A and 21B are explanatory views for a configuration of switching between positional indicators of a binding processing unit according to a tenth embodiment.
Figure 21B:
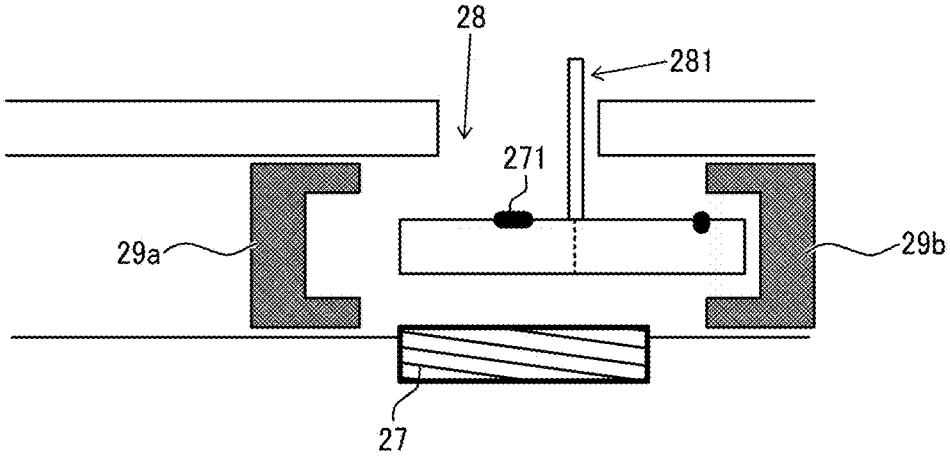

Next, a binding processing unit 100 according to another embodiment will be described. FIGS. 21A and 21B are cross-sectional views of the binding processing unit 100 according to the present embodiment. As exemplified in FIGS. 21A and 21B, provided is a slide plate sensor 29 as a positional indicator detector that detects which one of a plurality of types of markings 271 on a transparent slide plate 28 positioned due to sliding is identical to a position corresponding to the binding position.

The slide plate sensor 29 includes slide plate sensors, of which the number is identical to the number of markings 271, located at terminations in the slide direction of the transparent slide plate 28. For example, referring to FIGS. 21A and 21B, in a case where the transparent slide plate 28 is slidable one-dimensionally, an end binding detection slide plate sensor 29*a* and an oblique binding detection slide plate sensor 29*b* are disposed, respectively, on one side and the other side in the slide direction of the transparent slide plate 28. The end binding detection slide plate sensor 29*a* detects that the transparent slide plate 28 has been brought to one termination. The oblique binding detection slide plate sensor 29*b* detects that the transparent slide plate 28 has been brought to the other termination.

Figure 22A:
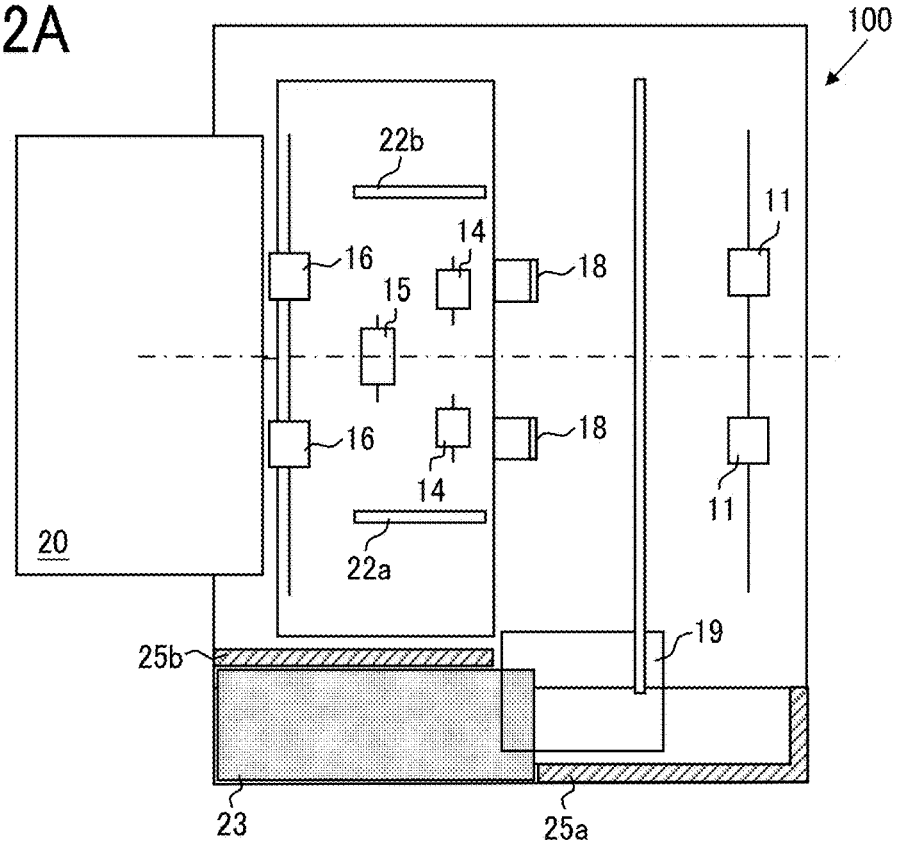
FIGS. 22A and 22B illustrate an exemplary distinctive configuration of the binding processing unit according to the tenth embodiment.

As illustrated in FIG. 21A, in a case where the transparent slide plate 28 is located close to or in contact with the end binding detection slide plate sensor 29*a*, the marking 271 for end binding is located at a position corresponding to the binding position. In this case, as illustrated in FIG. 22A, a stapling unit 19 is moved to the end binding position.

Figure 22B:
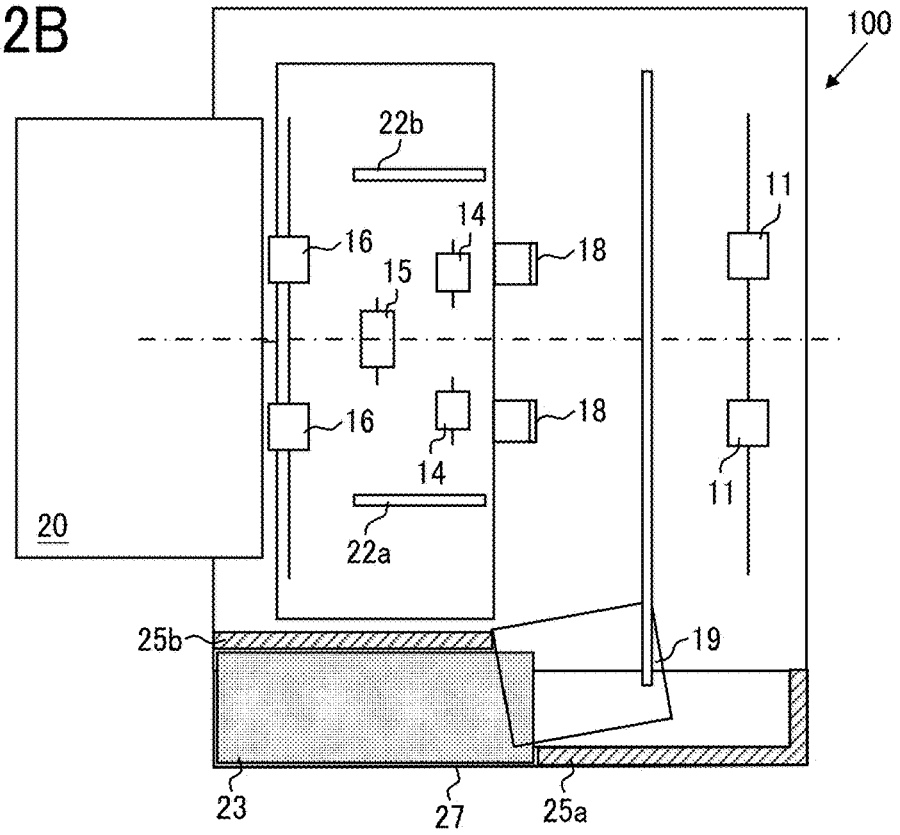

As illustrated in FIG. 21B, in a case where the transparent slide plate 28 is located close to or in contact with the oblique binding detection slide plate sensor 29*b*, the marking 271 for oblique binding is located at a position corresponding to the binding position. In this case, as illustrated in FIG. 22B, the stapling unit 19 is moved to the oblique binding position.

Based on a detection signal from the slide plate sensor 29, a CPU 110 in the binding processing unit 100 according to the present embodiment determines which binding has been selected, end binding or oblique binding. Binding processing is controlled based on a result of the determination, leading to a change in the type of binding processing (manner for binding processing) responsive to the selected type of positional indicator (marking 271).

The slide plate sensor 29 is not limited in type and thus may be a transmissive sensor or a reflective sensor. The binding method is not limited to end binding and oblique binding. The slide plate sensor 29 may be any sensor, provided that the transparent slide plate 28 can be detected.

Binding Processing Unit According to Eleventh Embodiment

Figure 23A:
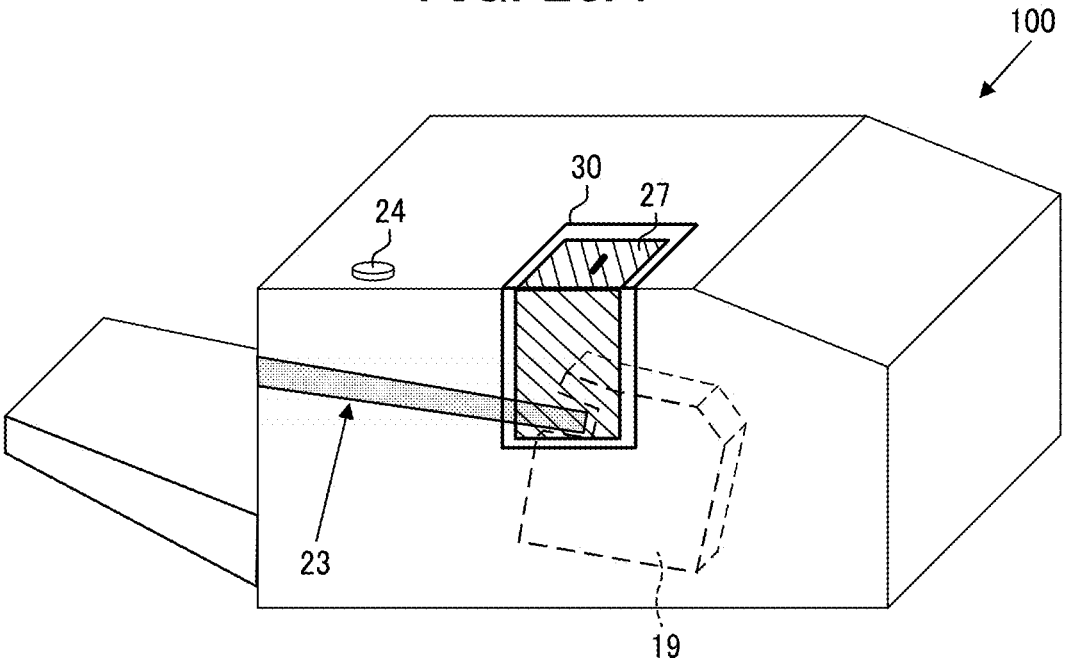
FIGS. 23A and 23B illustrate an example of installation of a positional indicator to a binding processing unit according to an eleventh embodiment.
Figure 23B:
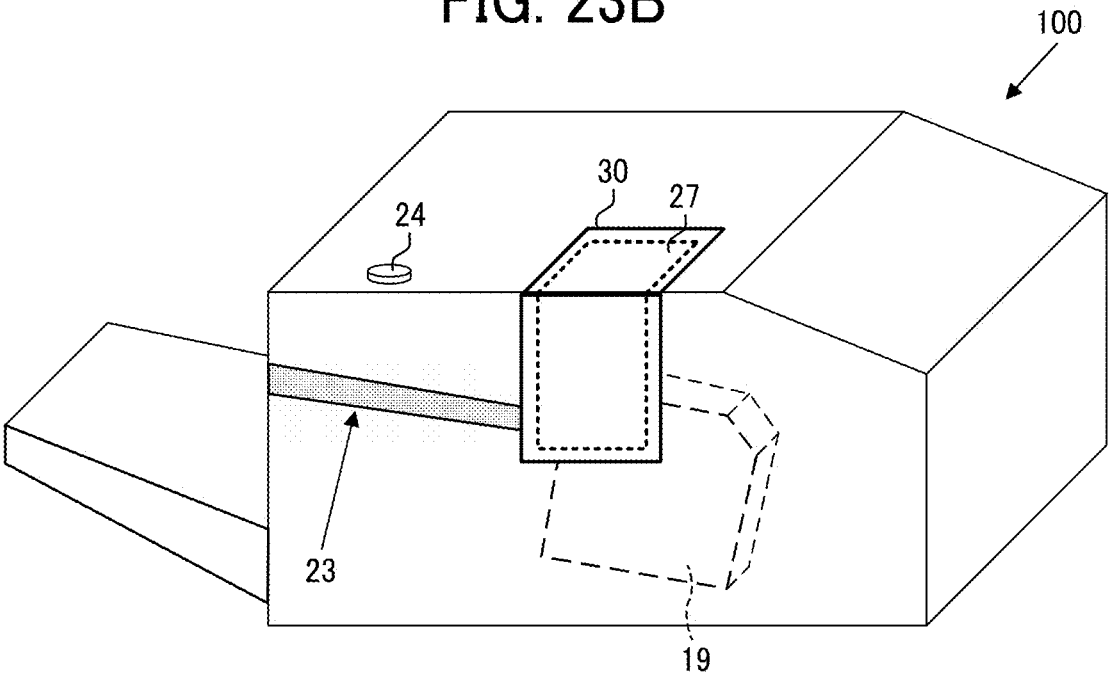

Next, a binding processing unit 100 according to another embodiment will be described. FIGS. 23A and 23B are perspective views of the binding processing unit 100 according to the present embodiment. As exemplified in FIGS. 23A and 23B, the binding processing unit 100 according to the present embodiment includes a transparent plate 27 having its surface on which a light control film 30 is disposed. In a case where manual binding processing is allowed, the light control film 30 is brought into a transparent state. In a case where no manual binding processing is allowed, the light control film 30 is brought into an opaque state.

The light control film 30 is a film-shaped member of which the transparency can be changed due to energization, that is, the transparency can be controlled due to adjustment of applied voltage. For example, the light control film 30 is opaque in energization and is transparent in non-energization.

FIG. 23A exemplifies the light control film 30 having been energized (in energization). FIG. 23B exemplifies the light control film 30 having not been energized (in non-energization).

Figure 24A:
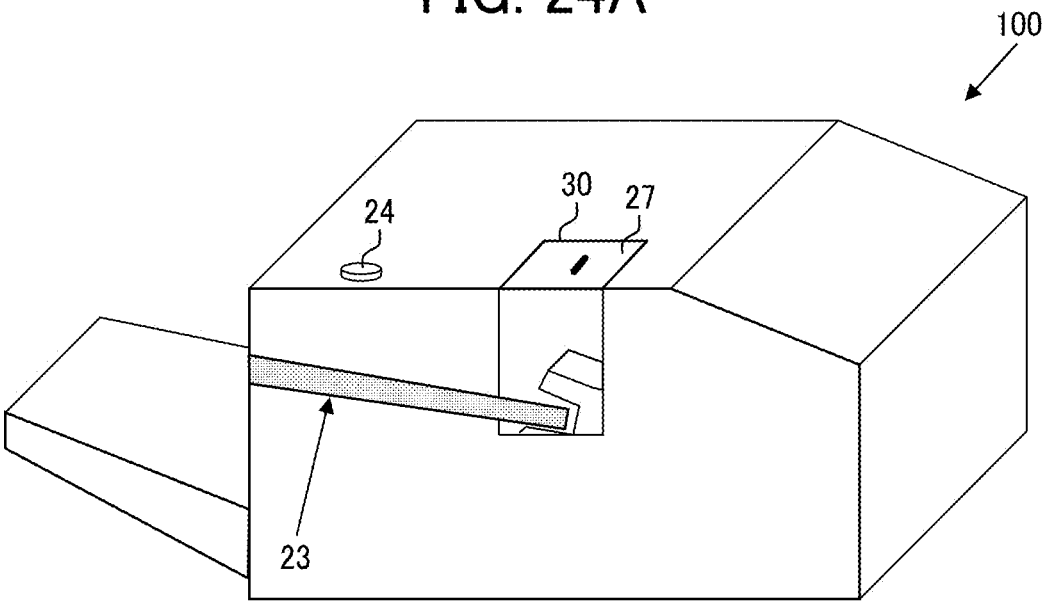
FIGS. 24A and 24B illustrate the example of installation of a positional indicator to the binding processing unit according to the eleventh embodiment.

For example, in a case where a stapling unit 19 is located at the performable position of manual binding processing like the exemplification in FIG. 9A, as illustrated in FIG. 24A, the light control film 30 is transparent without energization. Thus, the binding position can be visually verified from outside, so that manual binding processing can be performed with visual verification of the binding position for a sheet bundle Sb.

Figure 24B:
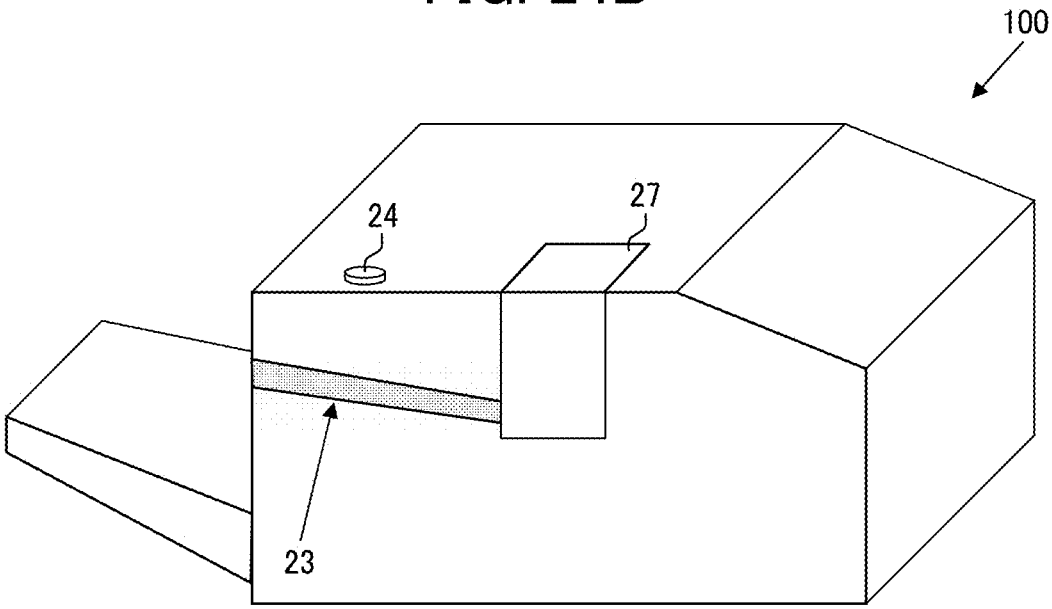

In a case where the stapling unit 19 is located out of the performable position of manual binding processing like the exemplification in FIG. 9B, as illustrated in FIG. 24B, the light control film 30 is opaque with energization. Thus, a user can recognize that no stapling unit 19 is present at the performable position of manual binding processing. In other words, in a case where the user fails to verify the binding position in the binding processing unit 100 because the light control film 30 is opaque, the user can recognize that manual binding processing is not allowed to be performed.

Binding Processing Unit According to Twelfth Embodiment

Next, a binding processing unit 100 according to another embodiment will be described. In a case where a stapling unit 19 has moved to a position at which manual binding processing is allowed like the exemplification in FIG. 24A in the eleventh embodiment, the binding position is made visible, so that a user can be notified that manual binding processing can be performed.

A user notifier is not limited to the above. For example, used may be a notifier that emits a sound in response to detection of insertion of a sheet bundle Sb to the bindable position in a slit 23. For example, a sheet bundle sensor 31 is provided to a conveyance direction stopper 25*a* and a width direction stopper 25*b*. The sheet bundle sensor 31 outputs, to a CPU 110, a detection signal indicating that a sheet bundle Sb has hit against the stoppers.

Based on the detection signal from the sheet bundle sensor 31, the CPU 110 causes a speaker 311 as a notifier to emit a sound to notify the user that manual binding processing is allowed. Alternatively, in a case where a display 303 or an operation device 304 includes a sound output mechanism, the user may be notified, through an electronic sound or a voice, that manual binding processing is allowed.

Binding Processing Unit According to Thirteenth Embodiment

Figure 25A:
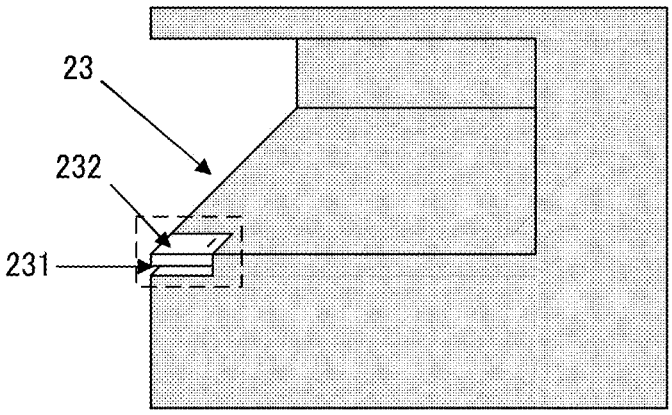
FIGS. 25A to 25C illustrate an example of installation of a positional indicator to a binding processing unit according to a thirteenth embodiment.
Figure 25B:
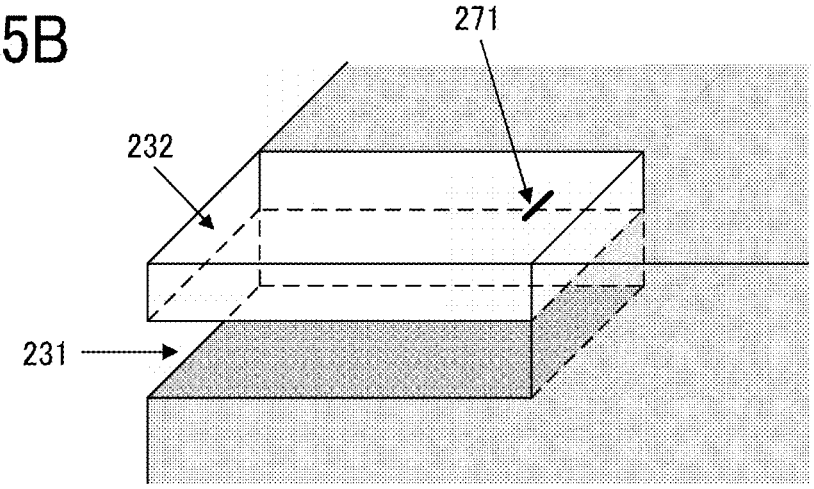
Figure 25C:
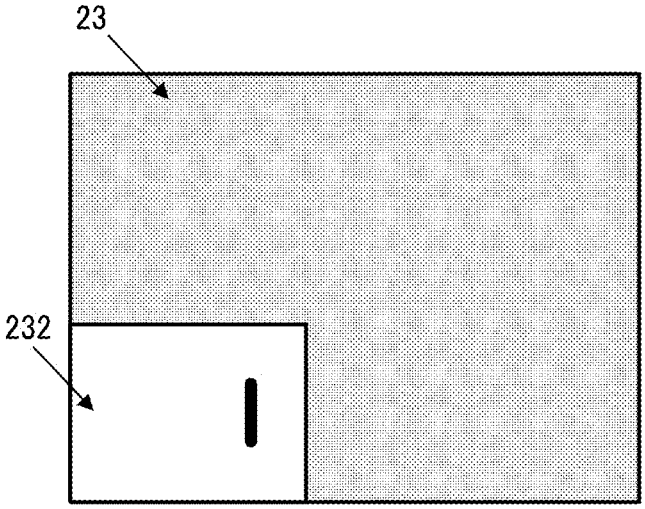

Next, a binding processing unit 100 according to another embodiment will be described. FIG. 25A is a perspective view of the binding processing unit 100 according to the present embodiment. Referring to FIG. 25A, a small-scale slit 231 is provided to part of an outer cover corresponding to the opening of a slit 23 included in the binding processing unit 100 according to the present embodiment. FIG. 25B is an enlarged perspective view of the small-scale slit 231. FIG. 25C is an enlarged plan view of the small-scale slit 231.

The small-scale slit 231 has a shape similar to the shape of a section that the slit 23 has near hitting positions against a sheet bundle Sb. The small-scale slit 231 is provided with a transparent small plate 232 as the top of the small-scale slit 231. The transparent small plate 232 is provided with a marking 271. Note that the "shape of a section near hitting positions against a sheet bundle Sb" means a shape similar to the shape of a section near the binding position for the sheet bundle Sb having ends hit against a conveyance direction stopper 25*a* and a width direction stopper 25*b*.

Since part of the opening is provided with the small-scale slit 231 and the transparent small plate 232 having the marking 271 is disposed as the top of the small-scale slit 231, the binding position for a sheet bundle Sb can be visually verified before insertion of the sheet bundle Sb in the slit 23.

Figure 26A:
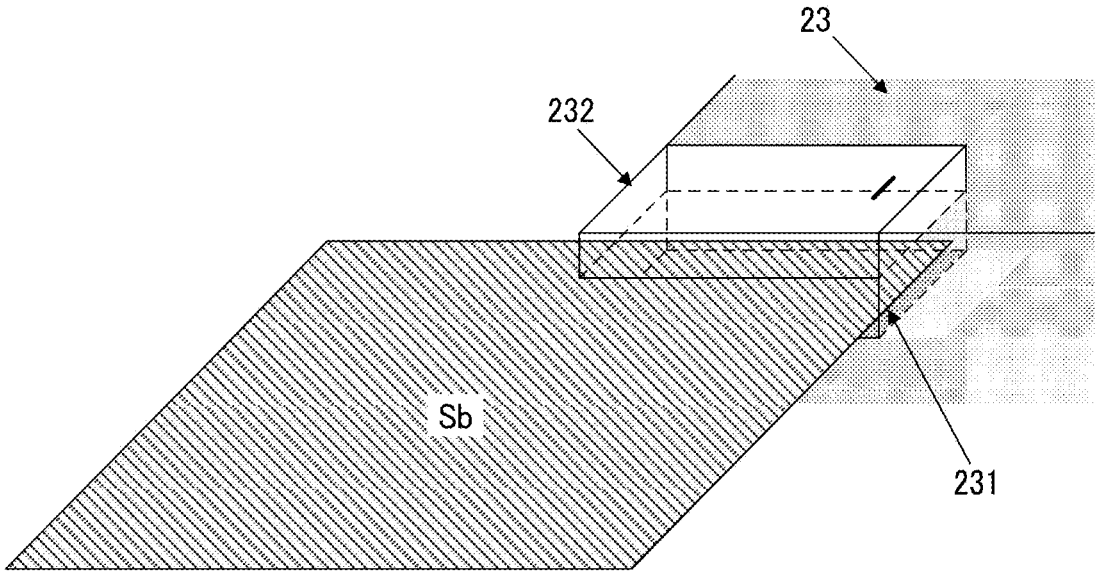
FIGS. 26A and 26B are explanatory views for exemplary usage of the positional indicator of the binding processing unit according to the thirteenth embodiment.
Figure 26B:
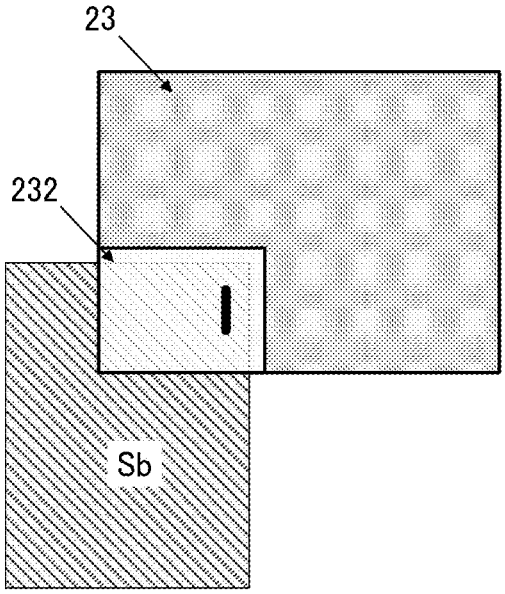

FIGS. 26A and 26B illustrate a sheet bundle Sb inserted in the small-scale slit 231. FIG. 26A is a perspective view. FIG. 26B is a plan view. As exemplified in FIG. 26A, the sheet bundle Sb has a leading end (portion to be subjected to binding processing) inserted in the small-scale slit 231. Verification of the position at which the given mark (marking 271) overlaps the sheet bundle Sb enables verification of the binding position before manual binding processing.

The verified position corresponds to the binding position of manual binding processing to the sheet bundle Sb inserted in the slit 23. Thus, verification can be performed in advance as to whether or not binding processing is to be performed to any unintended place (e.g., to any portion on which an image or character is printed).

In conventional manual binding processing with an internal medium processing configuration the binding position is difficult to visually verify because a binding unit is located inside. However, such a disadvantage can be solved with the binding processing unit 100 according to each embodiment described above.

That is, in manual binding to a sheet bundle Sb with such a conventional configuration, verification fails to be performed in advance as to whether or not the binding position overlaps the image formed position. Thus, binding is performed at the image formed position, leading to a deterioration in the quality of a finished sheet bundle. In contrast to this, the binding processing unit 100 according to each embodiment enables a user who performs manual binding to visually verify the binding position for a sheet bundle Sb before binding processing. Thus, the user can verify, in advance, which position on the sheet bundle Sb binding processing is to be performed to, leading to prevention of binding at the image formed position.

In other words, a medium processing apparatus can be equipped with a transparent outer cover provided with a positional indicator such that an intended position for binding overlaps a sheet bundle at the time of inward viewing at a certain angle. Thus, a user can verify the relationship between the position of a sheet bundle and the binding position inside the manual binding slit. In manual binding processing, the user can perform binding processing while verifying the binding position precisely, leading to an improvement in the accuracy of the binding position for the sheet bundle.

Embodiments of the present disclosure are not limited to the above-described embodiments, and numerous additional modifications and variations are possible in light of the teachings within the technical scope of the present disclosure. It is therefore to be understood that the above-described embodiments of the present disclosure may be practiced otherwise by those skilled in the art than as specifically described herein. Such modifications and variations are included in the technical scope described in the appended claims.

Aspects of the present disclosure are, for example, as follows.

Aspect 1

According to Aspect 1, provided is a medium processing apparatus for bundling multiple sheets as sheet-shaped media together to form a sheet bundle, the medium processing apparatus including:

a binder that binds the multiple sheets;

a sheet inserter including an opening allowing the multiple sheets in a stack to be inserted from outside to a performable position of binding processing by the binder; and a binding position verifier allowing the performable position for the multiple sheets to be verified from outside in a case where the multiple sheets is inserted in the sheet inserter.

Aspect 2

According to Aspect 2, in the medium processing apparatus of Aspect 1, the binding position verifier includes a verification outer cover that is part of an outer cover of the medium processing apparatus and allows the performable position to be visually verified from outside.

Aspect 3

According to Aspect 3, in the medium processing apparatus of Aspect 2, the verification outer cover includes a positional indicator indicating a binding position at which the binding processing is to be performed, at a position overlapping the performable position, and allows the positional indicator overlapping the multiple sheets inserted through the opening to be visually verified from outside.

Aspect 4

According to Aspect 4, in the medium processing apparatus of Aspect 3, the verification outer cover has a top portion provided with the positional indicator.

Aspect 5

According to Aspect 5, in the medium processing apparatus of Aspect 3 or 4, the verification outer cover has a lateral portion provided with the positional indicator.

Aspect 6

According to Aspect 6, in the medium processing apparatus of any one of Aspects 3 to 5, the positional indicator includes multiple positional indicators provided corresponding one-to-one to a plurality of binding positions at which the binding processing is allowed.

Aspect 7

According to Aspect 7, in the medium processing apparatus of Aspect 6, the binder changes a type of the bind processing in response to a type of the positional indicator.

Aspect 8

According to Aspect 8, in the medium processing apparatus of any one of Aspects 2 to 7, the verification outer cover includes, as a part, a light control film switchable between a transparent state and an opaque state, the light control film being in the transparent state in a case where the multiple sheets is located at the performable position.

Aspect 9

According to Aspect 9, the medium processing apparatus of any one of Aspects 1 to 8 further includes:

a sheet detector that detects the multiple sheets inserted in the sheet inserter; and a notifier that issues a notification that part of the multiple sheets has reached the performable position.

Aspect 10

According to Aspect 10, in the medium processing apparatus of any one of Aspects 1 to 9, the opening has an end including an indicator allowing visual verification of a binding position on the multiple sheets in the binding processing to the multiple sheets.

Aspect 11

According to Aspect 11, an image forming apparatus includes:

a housing;

an image forming device housed in the housing, the image forming device forming an image on a sheet-shaped medium; and the medium processing apparatus of any one of Aspects 1 to 10, the medium processing apparatus being detachably supported in the housing, the medium processing apparatus performing binding processing to the sheet-shaped medium on which the image is formed by the image forming device.

Aspect 12

According to Aspect 12, an image forming system includes:

an image forming apparatus that forms an image on a sheet-shaped medium; and the medium processing apparatus of any one of Aspects 1 to 11, the medium processing apparatus being connected to the image forming apparatus.

The functionality of the elements such as the binding processing controller 102 or the binding processor 101 disclosed herein may be implemented using circuitry or processing circuitry which includes general purpose processors, special purpose processors, integrated circuits, application-specific integrated circuits (ASICs), field-programmable gate arrays (FPGAs), and/or combinations thereof which are configured or programmed, using one or more programs stored in one or more memories, to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein which is programmed or configured to carry out the recited functionality.

There is a memory that stores a computer program which includes computer instructions. These computer instructions provide the logic and routines that enable the hardware (e.g., processing circuitry or circuitry) to perform the method disclosed herein. This computer program can be implemented in known formats as a computer-readable storage medium, a computer program product, a memory device, a record medium such as a CD-ROM or DVD, and/or the memory of an FPGA or ASIC.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

The invention claimed is:

1. A medium processing apparatus comprising:

a binder to bind multiple sheets at a binding position to form a sheet bundle;

a sheet inserter having an opening into which the sheet bundle is insertable from an outside of the sheet inserter to a bindable region having the binding position;

a binding position verifier allowing the multiple sheets, inserted from the opening to the bindable region, to be verifiable from an outside of the sheet inserter; and an outer cover to cover the binder, wherein the binding position verifier has a verification outer cover, in the outer cover, from which the binding position is visually verifiable from an outside of the outer cover.

2. The medium processing apparatus according to claim 1, wherein the verification outer cover includes a positional indicator indicating the binding position in the bindable region, and the verification outer cover allows a visual verification of the positional indicator, on which the multiple sheets inserted into the opening are overlapped, from the outside of the outer cover.

3. The medium processing apparatus according to claim 2, wherein the verification outer cover includes the positional indicator on a top of the verification outer cover.

4. The medium processing apparatus according to claim 2, wherein the verification outer cover includes the positional indicator on a lateral wall of the verification outer cover.

5. The medium processing apparatus according to claim 2, wherein the binder is configured to bind the multiple sheets at multiple binding positions having the binding position, the verification outer cover includes multiple positional indicators including the positional indicator, and the multiple positional indicators are respectively disposed at the multiple binding positions.

6. The medium processing apparatus according to claim 5, wherein the binder is configured to bind the multiple sheets with multiple types of bindings, and the binder is configured to change the multiple types of bindings in response to types of the multiple positional indicators.

7. The medium processing apparatus according to claim 1, wherein the verification outer cover includes a light control film switchable between a transparent state and an opaque state, and the light control film is in the transparent state in response to the sheet bundle positioning at the bindable region.

8. An image forming apparatus comprising:

a housing;

the medium processing apparatus according to claim 1, the medium processing apparatus being detachably attachable to the housing; and an image forming device in the housing, the image forming device to form an image on the multiple sheets, wherein the medium processing apparatus binds the multiple sheets on which the image is formed by the image forming device.

9. An image forming system comprising:

the medium processing apparatus according to claim 1; and an image forming apparatus configured to form an image on the multiple sheets, wherein the medium processing apparatus is coupled to the image forming apparatus.

10. A medium processing apparatus comprising:

a binder to bind multiple sheets at a binding position to form a sheet bundle;

a sheet inserter having an opening into which the sheet bundle is insertable from an outside of the sheet inserter to a bindable region having the binding position;

a binding position verifier allowing the multiple sheets, inserted from the opening to the bindable region, to be verifiable from an outside of the sheet inserter;

a sheet detector to detect the multiple sheets inserted in the sheet inserter; and circuitry configured to issue a notification that a part of the multiple sheets has reached the binding position.

11. An image forming apparatus comprising:

a housing;

the medium processing apparatus according to claim 10, the medium processing apparatus being detachably attachable to the housing; and an image forming device in the housing, the image forming device to form an image on the multiple sheets, wherein the medium processing apparatus binds the multiple sheets on which the image is formed by the image forming device.

12. An image forming system comprising:

the medium processing apparatus according to claim 10; and an image forming apparatus configured to form an image on the multiple sheets, wherein the medium processing apparatus is coupled to the image forming apparatus.

13. A medium processing apparatus comprising:

a binder to bind multiple sheets at a binding position to form a sheet bundle;

a sheet inserter having an opening into which the sheet bundle is insertable from an outside of the sheet inserter to a bindable region having the binding position; and a binding position verifier allowing the multiple sheets, inserted from the opening to the bindable region, to be verifiable from an outside of the sheet inserter;

wherein the binding position verifier includes an indicator at an end of the opening, and the indicator allows the binding position of the multiple sheets bound by the binder to be visually verifiable from the outside of the sheet inserter.

14. An image forming apparatus comprising:

a housing;

the medium processing apparatus according to claim 13, the medium processing apparatus being detachably attachable to the housing; and an image forming device in the housing, the image forming device to form an image on the multiple sheets, wherein the medium processing apparatus binds the multiple sheets on which the image is formed by the image forming device.

15. An image forming system comprising:

the medium processing apparatus according to claim 13; and an image forming apparatus configured to form an image on the multiple sheets, wherein the medium processing apparatus is coupled to the image forming apparatus.

* * * * *